US010088782B2

(12) United States Patent
Yokoya et al.

(10) Patent No.: US 10,088,782 B2
(45) Date of Patent: Oct. 2, 2018

(54) IMAGE FORMING APPARATUS AND SYSTEM CONTROLLING RUBBING TREATMENT OF FIXING DEVICE

(71) Applicant: CANON KABUSHIKI KAISHA, Tokyo (JP)

(72) Inventors: Takashi Yokoya, Yoshikawa (JP); Satoru Yamamoto, Noda (JP); Toshiyuki Miyake, Abiko (JP); Katsuya Nakama, Nagareyama (JP); Koji Yumoto, Toride (JP); Riki Fukuhara, Kashiwa (JP); Akihiro Kawakita, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/227,431

(22) Filed: Aug. 3, 2016

(65) Prior Publication Data

US 2017/0038712 A1 Feb. 9, 2017

(30) Foreign Application Priority Data

Aug. 4, 2015 (JP) ..... 2015-154350

(51) Int. Cl.
*G03G 15/20* (2006.01)

(52) U.S. Cl.
CPC ..... *G03G 15/2025* (2013.01); *G03G 15/2075* (2013.01)

(58) Field of Classification Search
CPC ..... G03G 15/2025; G03G 15/2075; G03G 21/1685; G03G 2221/1639
(Continued)

(56) References Cited

U.S. PATENT DOCUMENTS 6,016,409 A * 1/2000 Beard ..... G03G 15/2064 399/110
7,460,821 B2 12/2008 Ai et al.
(Continued)

FOREIGN PATENT DOCUMENTS

JP 07311517 A * 11/1995
JP 2008-040364 A 2/2008
JP 2011-056945 A 3/2011

OTHER PUBLICATIONS

Copending, unpublished U.S. Appl. No. 15/136,256, dated Apr. 22, 2016, to Nobuhiro Kikuchi et al.
(Continued)

*Primary Examiner* — Robert Beatty
(74) *Attorney, Agent, or Firm* — Fitzpatrick, Cella, Harper & Scinto

(57) ABSTRACT

An image forming apparatus includes an image fixing portion detachably mountable to a main assembly and including first and second rollers forming an image fixing nip therebetween; a rubbing roller for rubbing treatment of the first roller; a setting portion for setting whether to permit the execution of the treatment when a number of the recording materials fed to the fixing portion exceeds a predetermined number; a storing portion, provided in the fixing portion, for storing set information corresponding to the setting relating to permission of the treatment set through the setting portion; and a controller for controlling execution of the treatment. If the set information in the storing portion indicates the permission of the treatment, the controller executes the treatment. If not, the controller does not execute the treatment.

26 Claims, 27 Drawing Sheets

(58) Field of Classification Search
USPC ..... 399/43, 122, 327
See application file for complete search history.

(56) References Cited

U.S. PATENT DOCUMENTS

| | | | | |
|---|---|---|---|---|
| 8,559,838 | B2 * | 10/2013 | Ogawahara | G03G 15/2064 399/12 |
| 2003/0210936 | A1 * | 11/2003 | Matsumoto | G03G 15/2064 399/327 |
| 2005/0185978 | A1 * | 8/2005 | Kemmochi | G03G 15/2017 399/69 |
| 2009/0297233 | A1 * | 12/2009 | Kameda | G03G 15/5029 399/322 |
| 2011/0058201 | A1 | 3/2011 | Mueller | |
| 2011/0157641 | A1 * | 6/2011 | Furukawa | G03G 15/5075 358/1.15 |

OTHER PUBLICATIONS

Copending, unpublished U.S. Appl. No. 15/218,181, dated Jul. 25, 2016, to Katsuya Nakama et al.

* cited by examiner

| SHEET SIZES | COUNTS |
|---|---|
| ~185mm | 98 |
| ~190mm | 0 |
| ~195mm | 0 |
| ~200mm | 0 |
| ~205mm | 0 |
| ~210mm | 349 |
| . | |
| . | |

| DEVICE ID | REFRESHING SETTING |
|---|---|
| 1 | EXECUTE |
| 2 | NOT-EXECUTE |
| 3 | EXECUTE |
| … | … |

Fig. 13

(a)

| | |
|---|---|
| DEVICE ID | 1 |
| REFRESHING SETTING | EXECUTE |
| RENEWED TIME | 2015/01/15 12:00:00 |

(b)

| DEVICE ID | REFRESHING SETTING | RENEWED TIME |
|---|---|---|
| 1 | EXECUTE | 2015/01/10 12:00:00 |
| 2 | NOT-EXECUTE | 2015/01/09 11:00:00 |
| 3 | EXECUTE | 2013/07/10 15:30:00 |
| ... | ... | |

Fig. 26

IMAGE FORMING APPARATUS AND SYSTEM CONTROLLING RUBBING TREATMENT OF FIXING DEVICE

FIELD OF THE INVENTION AND RELATED ART

The present invention relates to an image forming apparatus of an electrophotographic type, an image forming system including the image forming apparatus of the electrophotographic type and a fixing device usable with the image forming apparatus of the electrophotographic type.

The electrophotographic type image forming apparatus comprises a fixing device (fixing portion) for fixing the toner image on a recording material. It is known to replace the fixing device depending on the size and/or kind of the recording material for the purpose of high quality prints. Japanese Laid-open Patent Application 2011-56945, for example, proposes that identifying information of the fixing device is detected, and when the fixing device is not proper for the requirements of the printing job to be performed, the user is notified of the fact.

On the other hand, when an unfixed toner image is fixed in a fixing device, a widthwise edge of the recording material (an edge at an end portion of the recording material with respect to a direction perpendicular to a feeding direction of the recording material) contacts a (rotatable member) with the result of fine scores of the surface of the fixing member. When the recording materials having the same width size measured in the direction perpendicular to the feeding direction of the recording material are repeatedly processed for the image fixing, the damage occurs at the same positions of the fixing member. The surface properly of the fixing member is poorer at the damage portions than the other portion. If, then, the large size recording materials having the large width size is processed for the image fixing, there is a likelihood that glossiness unevenness IP is produced on the image of the recording material. Therefore, it is known that the surface of the fixing member is rubbed by a rubbing rotatable member (fixing refresh operation) each predetermined number of the recording materials process by the fixing member, by which the surface property of the fixing member is uniformized (Japanese Laid-open Patent Application 2008-40364).

On the other hand, using a method in which the fixing device is exchanged with another one, the user may use one particular fixing device exclusively for the recording materials having the particular width size. In such a case, the adverse effect of the scores caused at the widthwise edges may be ignored, and therefore, it is desirable that an operation mode is selected so as not to carry out the fixing element refreshing operation. That is, it is desirable that each fixing device can be set for the permissible fixing element refreshing operation or for the prohibited fixing element refreshing operation, in such a case.

However, if the operator carries out such settings upon each exchange of the fixing device, the usability is deteriorated.

SUMMARY OF THE INVENTION

It is another object of the present invention to provide an image forming apparatus, an image forming system and an image fixing device with which the usability is high even when the fixing devices are exchangeably usable.

According to an aspect of the present invention, there is provided an image forming apparatus comprising an image forming station configured to form an unfixed toner image on a recording material; a fixing portion detachably mountable to a main assembly of said image forming apparatus, said fixing portion including a first rotatable member and a second rotatable member which cooperate with each other to form a nip for fixing the unfixed toner image formed on the recording material by said image forming station; a rubbing rotatable member capable of rubbing a surface of said first rotatable member; a setting portion configured to set by an operator whether to permit the execution of a rubbing treatment of said rubbing rotatable member when a number of the recording materials fed to said fixing portion exceeds a predetermined number; a storing portion provided in said fixing portion and capable of storing set information corresponding to the setting relating to the permission of the rubbing treatment set through said setting portion; and a controller configured to control whether to execute the rubbing treatment of said rubbing rotatable member, wherein when the set information acquired from said storing portion indicates the permission of the rubbing treatment, said controller executes the rubbing treatment of the rubbing rotatable member, and when the set information acquired from said storing portion does not indicate the permission of the rubbing treatment, said controller does not execute the rubbing treatment of the rubbing rotatable member.

According to another aspect of the present invention, there is provided an image forming system comprising an image forming apparatus configured to form an image on a recording material; and a storing device communicatably connected with said image forming apparatus and capable of storing information, wherein said image forming apparatus including, an image forming station configured to form an unfixed toner image on the recording material; a fixing portion detachably mountable to a main assembly of said image forming apparatus, said fixing portion including a first rotatable member and a second rotatable member which cooperate with each other to form a nip for fixing the unfixed toner image formed on the recording material by said image forming station, said fixing portion further including a discrimination portion having identifying information for discrimination from another fixing portion replaceable with said fixing portion; a rubbing rotatable member capable of rubbing a surface of said first rotatable member; a setting portion configured to set by an operator whether to permit the execution of a rubbing treatment of said rubbing rotatable member when a number of the recording materials fed to said fixing portion exceeds a predetermined number; a recording portion capable of recording set information corresponding to the setting relating to the permission of the rubbing treatment set through said setting portion, in said storing portion in correlation with the identifying information of said fixing portion; and a controller configured to execute the rubbing treatment of said rubbing rotatable member when the set information stored in said storing portion in correlation with the identifying information of said fixing portion mounted in said image forming apparatus indicates the permission of the rubbing treatment, and configured not to execute the rubbing treatment of said rubbing rotatable member when the set information stored in said storing portion in correlation with the identifying information of said fixing portion mounted in said image forming apparatus does not indicate the permission of the rubbing treatment.

According to a further aspect of the present invention, there is provided an image forming apparatus comprising an image forming station configured to form an unfixed toner image on a recording material; a fixing portion detachably mountable to a main assembly of said image forming apparatus, said fixing portion including a first rotatable member and a second rotatable member which cooperate with each other to form a nip for fixing the unfixed toner image formed on the recording material by said image forming station, said fixing portion further including a discrimination portion having identifying information for discrimination from another fixing portion replaceable with said fixing portion and a fixing portion storing portion capable of storing information; a rubbing rotatable member capable of rubbing a surface of said first rotatable member; a main assembly storing portion capable of storing information; a setting portion configured to set by an operator whether to permit the execution of a rubbing treatment of said rubbing rotatable member when a number of the recording materials fed to said fixing portion exceeds a predetermined number; a recording portion capable of recording set information corresponding to the setting relating to the permission of the rubbing treatment set through said setting portion, in said fixing portion storing portion in correlation with the identifying information of said fixing portion, and capable of recoding the set information and the identifying information in said main assembly storing portion in correlation with each other; and a controller configured to execute the rubbing treatment of said rubbing rotatable member when the set information stored in said fixing portion storing portion and the information acquired from said main assembly storing portion indicate the permission of the rubbing treatment for said fixing portion mounted in the main assembly of said image forming apparatus, and configured not to execute the rubbing treatment of said rubbing rotatable member when the set information stored in said fixing portion storing portion and the information acquired from said main assembly storing portion does not indicate the permission of the rubbing treatment for said fixing portion mounted in the main assembly of said image forming apparatus.

According to a further aspect of the present invention, there is provided a fixing device comprising a first rotatable member and a second rotatable member which cooperate with each other to form a nip for fixing a unfixed toner image formed on a recording material; a rubbing rotatable member configured to rub a surface of said first rotatable member; and a storing portion capable of storing information corresponding to a setting relating to whether to permit the execution of a rubbing treatment of said rubbing rotatable member when a number, exceeding a predetermined number, of the recording materials are fed to said fixing portion.

Further features of the present invention will become apparent from the following description of exemplary embodiments with reference to the attached drawings.

BRIEF DESCRIPTION OF THE DRAWINGS

FIG. 13 illustrates an example of information stored in the main assembly memory.

Part (a) of FIG. 26 illustrates an example of the information stored in the memory of the fixing device, and part (b) illustrates an example of the information stored in the main assembly memory.

Figure 27:
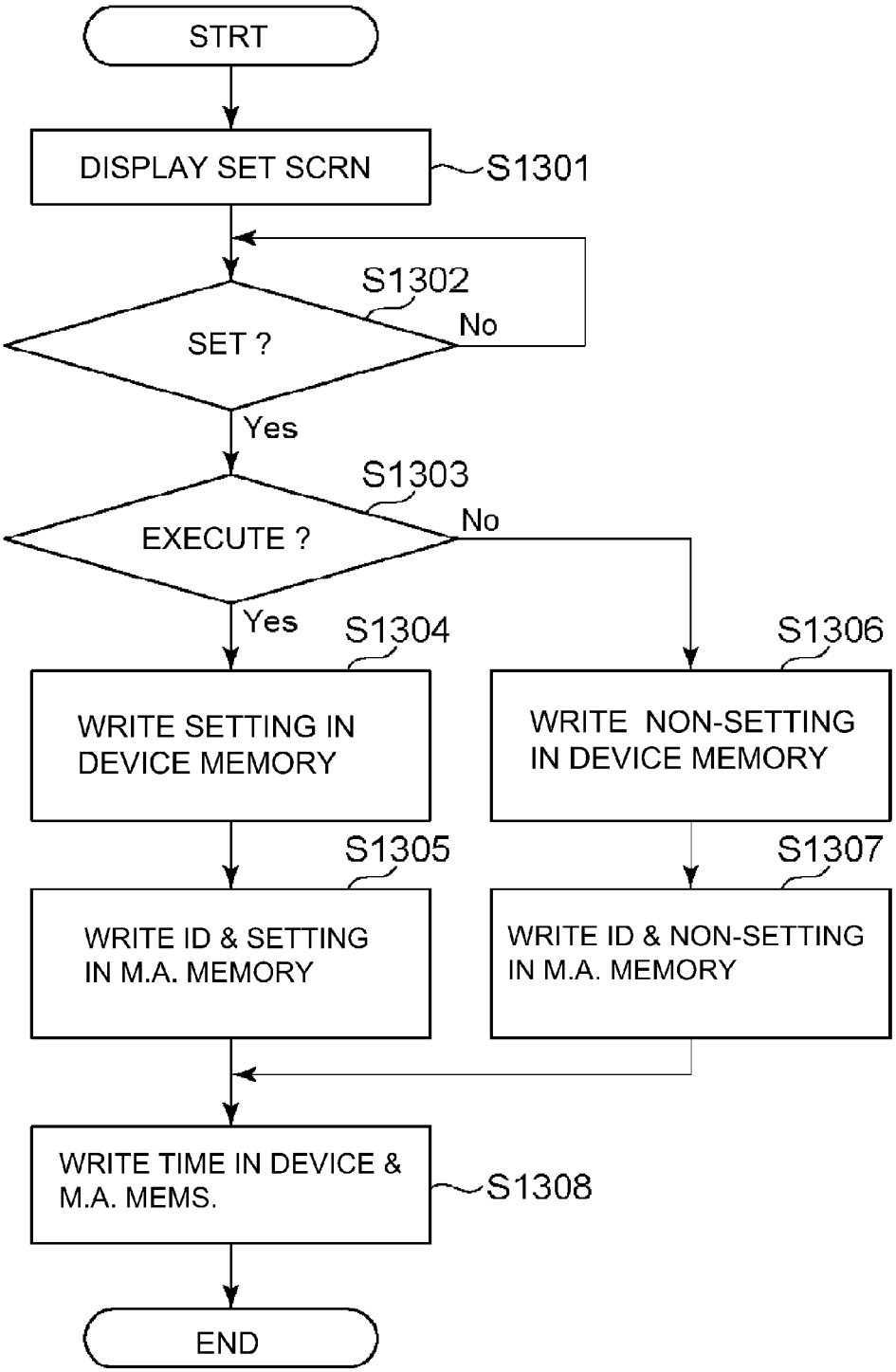

FIG. 27 is a flow chart of a setting sequence.

Figure 28:
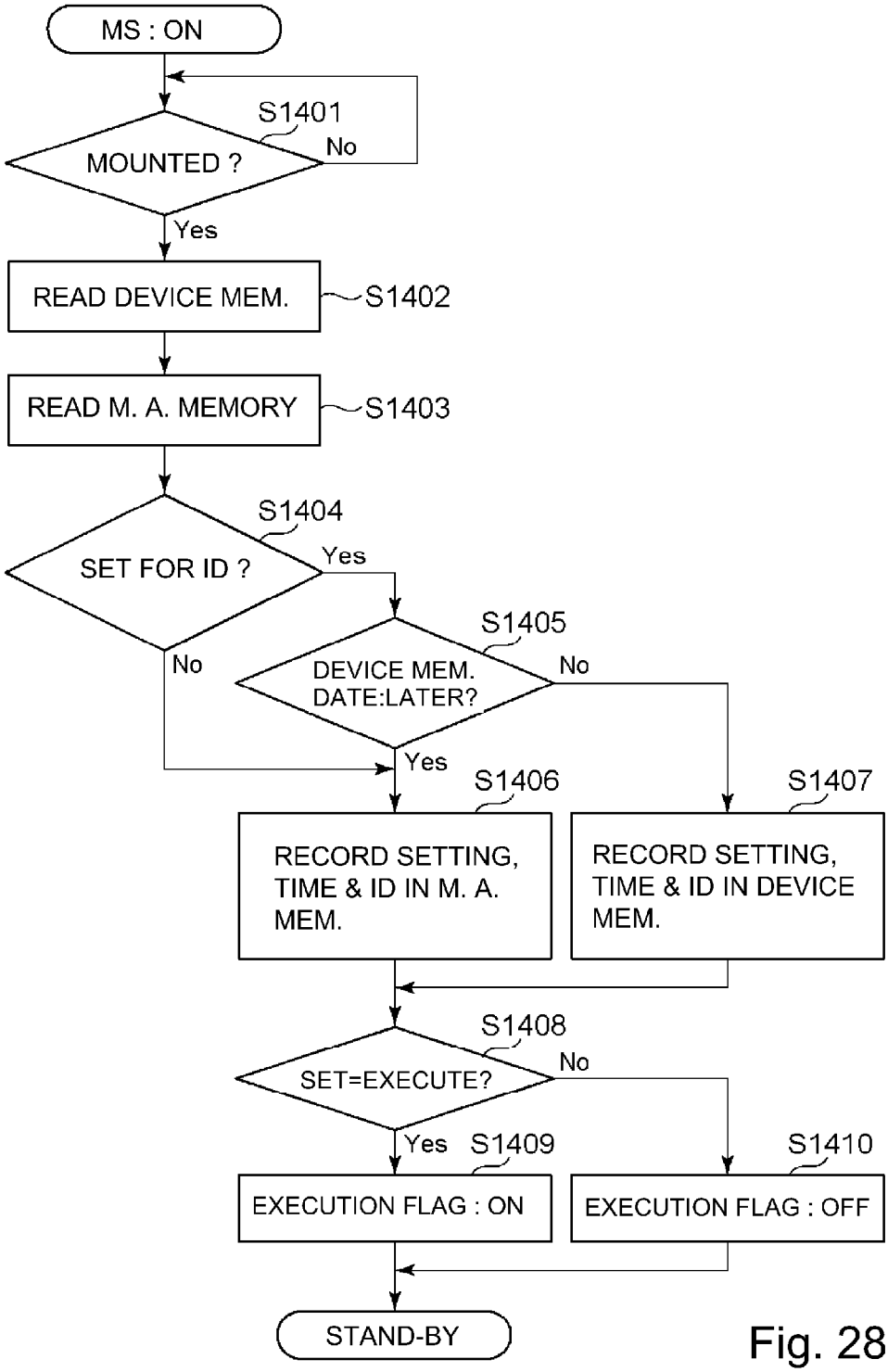

FIG. 28 is a flow chart showing the operations from the actuation of a main switch to a stand-by mode.

Figure 29:
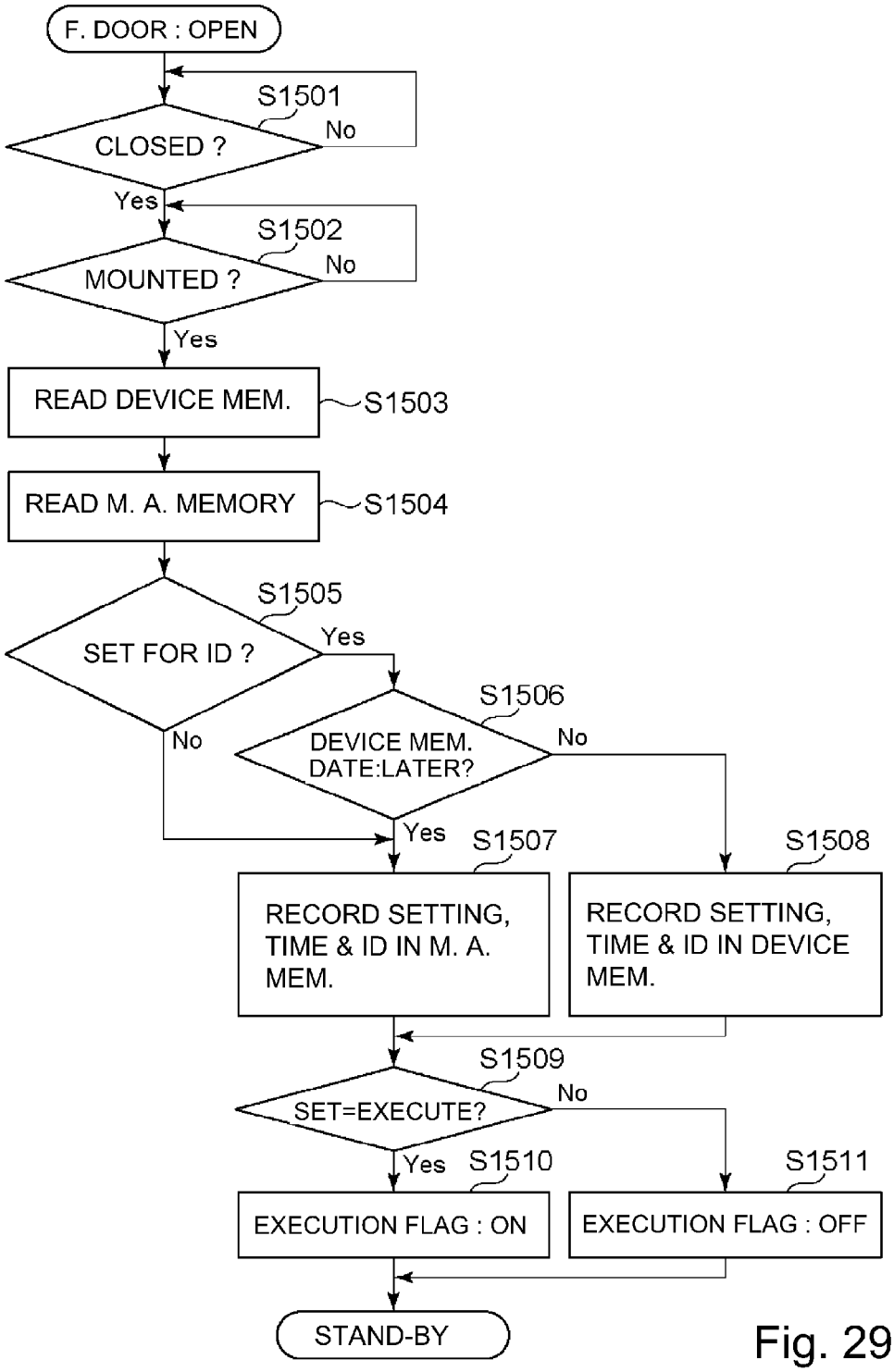

FIG. 29 is a flow chart showing the operations from the state in which a front door is open to the stand-by mode.

Figure 30:
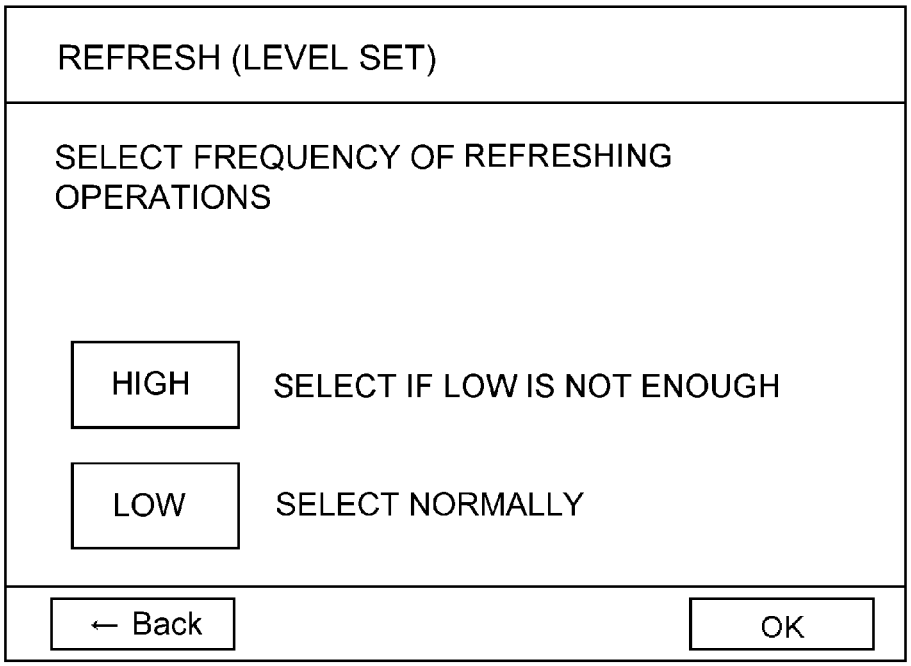

FIG. 30 shows an example of a display screen for refresh level setting.

DESCRIPTION OF THE EMBODIMENTS

The preferred embodiments of the present invention will be described in conjunction with the accompanying drawings. The structures of the embodiments are examples, to which the present invention is not limited.

[Embodiment 1]

(1. General Arrangement of Image Forming Apparatus)

Figure 1:
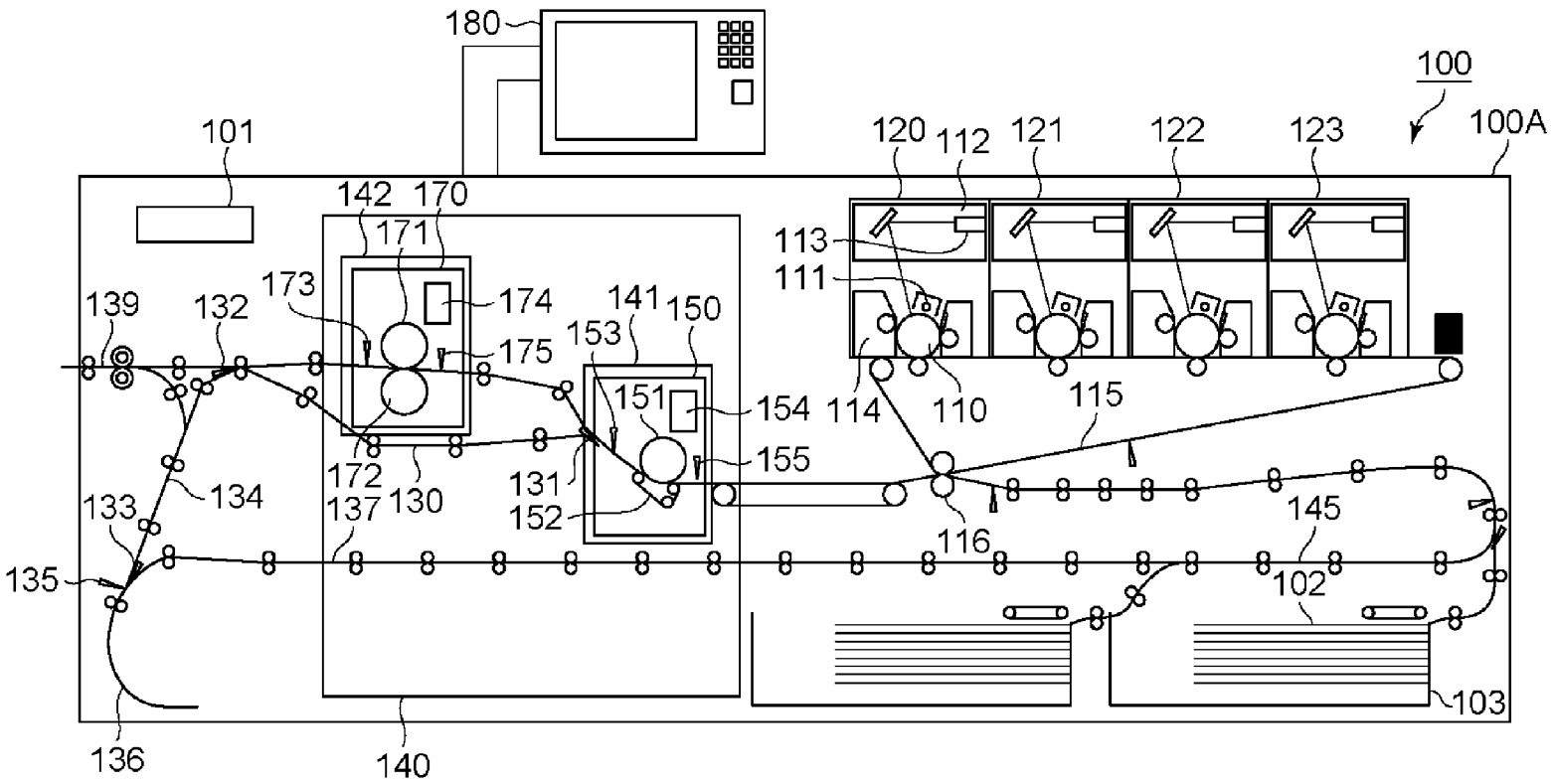
FIG. 1 is a sectional view of an example of an image forming apparatus.

FIG. 1 is a sectional view of an example of an image forming apparatus.

The general arrangement of the image forming apparatus 100 will be described.

The image forming apparatus 100 feeds a recording material 102 from a recording material accommodating portion 103 into an image forming station 309 (FIG. 2) to form a toner image on the recording material 102. The details of the image forming station 309 will be described hereinafter.

Thereafter, the image forming apparatus 100 feeds the recording material 102 carrying the formed toner image to a fixing portion (first fixing device 150 and second fixing device 170, where the toner image is fixed on the recording material 102 by heat and pressure. The details of the fixing portion will be described hereinafter.

In the case of a one-side printing operation, the recording material 102 having the fixed image is guided into the discharging path 139 by a flapper 132 and is discharged to an outside of the image forming apparatus 100.

On the other hand, in the case of the both side printing operation, the image forming apparatus 100 reverses the recording material 102 already having the image on one side and refeeds it into the image forming station 309. More particularly, the flapper 132 guides the recording material 102 having departed the fixing device into a feeding path 134 and then into a reversing portion 136. When a reversion sensor 135 detects a trailing edge of the recording material 102, a flapper 133 switch is the recording material feeding direction to a feeding path 137. The image forming apparatus 100 refeeds the reversed recording material 102 into the image forming station 309 and the fixing portion through the feeding path 137.

The recording material 102 having been subjected to the image forming operations and the respective sides is fed by the flapper 132 into the discharging path 139, and then is discharged to the outside of the image forming apparatus 100.

The flapper 132 is a switching member for switching the feeding of the recording material 102 having passed through the image forming station 309 and the fixing portion between the feeding path 134 and the outside of the image forming apparatus 100.

The recording material 102 may be paper, OHP sheet or the like and which the image is to be formed by the image forming apparatus 100.

An operating portion 180 functioning as a setting portion, a selector, a receiving portion and/or a notifying portion includes a display screen and selection keys. The operating portion 180 displays the status of the image forming apparatus 100 on the display screen, and receives the instructions from the operator by the selection keys. Examples of the operation include setting of a kind (surface property, basis weight, size or the like), setting of the number of the prints, setting of the single-sided print or double-sided print, or the like.

The main switch 101 is a starting switch for actuating the image forming apparatus 100.

The front door 140 as an opening and closing portion is provided for the opening of the main assembly of the image forming apparatus 100 for mounting a fixing device (first fixing device 150, second fixing device 170) to a mounting portion (first mounting portion 141, second mounting portion 142).

The image forming apparatus 100 is provided with an opening and closing sensor (optical sensor) 305 (FIG. 2) as a sensor for sensing a closed state of the front door 140. The opening and closing sensor 305 and the CPU301 (FIG. 2) function as an opening and closing detecting portion. The front door 140 is provided with a projection (unshown), which is inserted into a receiving portion (unshown) of the main assembly 100A of the image forming apparatus 100 by the closing of the front door 140. The CPU301 detects the closing of the front door 140 on the basis of a signal produced by the opening and closing sensor 305 upon the insertion of the projection into the receiving portion. On the other hand, when no output signal is produced by the opening and closing sensor 305, the CPU301 detects that the front door 140 is open.

In an alternative structure, the CPU301 detects the opening of the front door 140 on the basis of the signal produced by the opening and closing sensor 305 upon the opening of the front door 140, and the CPU301 detects that the front door 140 is closed when the signal from the sensor 305 is not detected.

(2. Structure of Control System)

Figure 2:
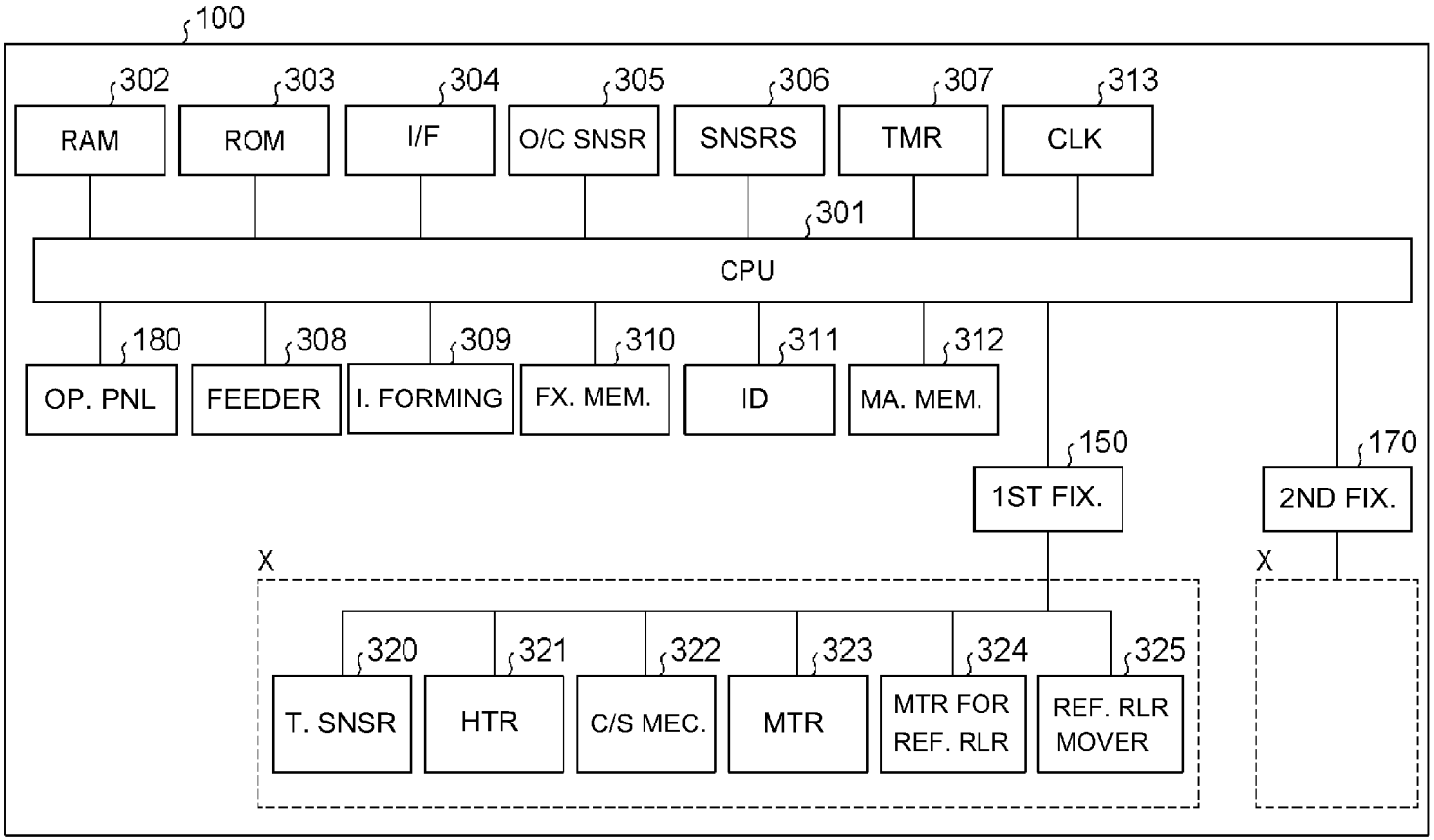
FIG. 2 is a block diagram of a control system.

FIG. 2 is a block diagram of a control system.

The image forming apparatus 100 (FIG. 1) is provided with CPU301, RAM 302, ROM 303 for controlling the operation of the image forming apparatus 100.

The CPU301 functioning as a controller carries out a basic control of the image forming apparatus 100 by executing control programs stored in the ROM 303. The CPU301 functioning as a controller carries out a basic control of the image forming apparatus 100 by executing control programs stored in the ROM 303. The CPU301 uses the RAM 302 as a work area for executing the processing of the control program.

The CPU301 is electrically connected with the RAM 302 and the ROM 303, and various mechanisms to be controlled.

Figures 3, 4:
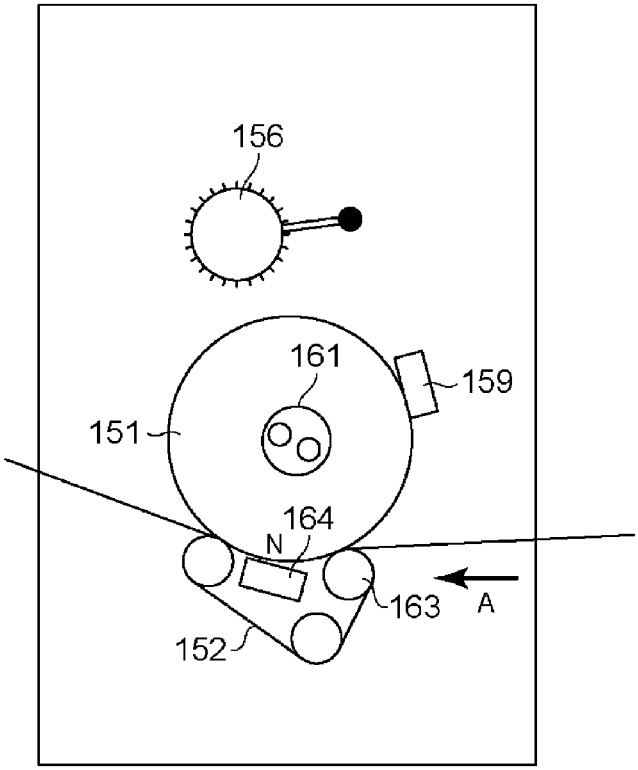
FIG. 3 is a sectional view of an example of a fixing portion.
FIG. 4 shows an example of counter information stored in a RAM.

In addition, the CPU301 functions also as a counter for counting the recording materials 102 fed into the first fixing device 150 or second fixing device 170. The CPU301 counts the recording materials on the RAM 302. For example, the CPU301 counts up the count on the RAM 302 for each detection of the feeding of the recording material 102 on the basis of the signal from the sensor 155 provided in the upstream side of a nip of the first fixing device 150 with respect to the feeding direction. By this, the CPU301 manages the number of the recording materials fed to the first fixing device 150. FIG. 4 shows an example of counter information stored in a RAM. In this example, the feeding number of the recording materials 102 is counted for each width of the recording material 102.

An external I/F portion 304 is a communication circuit for communication with an external device connected through network (LAN and/or WAN). The external device may include a PC or another image forming apparatus or the like.

The CPU301 is connected with the opening and closing sensor 305 to detect whether or not the front door 140 is closed.

The sensor group 306 including sensors 153 and 155, 173 and 175 shown in FIG. 1 is disposed along the feeding path, by which the CPU301 detects the presence, absence and passing of the recording material.

The CPU301 is connected with the operating portion 180. The CPU301 receives the instructions of switching of the display content on the display screen and other operations, given by the operator at the selection keys of the operating portion 180. The CPU301 displays, on the display screen of the operating portion 180, the status of operation of the image forming apparatus 100, an operation mode selected by the selection key, and so on.

The CPU301 is connected with a timer 307. The timer 307 functions as a clock portion for measuring a time period. It is used to count the time of the rubbing treatment in the fixing element refreshing operation.

The CPU301 is connected with the clock 313. The clock 313 functions as an output portion for outputting the time.

The CPU301 is connected with a feeding portion 308 to control feeding of the recording material 102. The feeding portion 308 includes a supply portion for feeding the recording material 102 from the recording material accommodating portion 103 to the feeding path, feeding rollers for feeding the recording material 102 on the feeding path and flappers (flappers 131, 132, 133, in FIG. 1) for the feeding paths.

In addition, the CPU301 is connected with the image forming station 309 which will be described hereinafter to control the image forming station 309.

The memory 310 of the fixing device includes the memory 154 of the first fixing device 150 mounted in the image forming apparatus 400, and a memory 174 of the second fixing device 170 mounted to the image forming apparatus 400. The CPU301 is connected with the memories 154, 174 of the first fixing device 150 and the second fixing device 170 mounted in the image forming apparatus 100 and writes in and read out of the memories 154, 174.

The CPU301 is connected with a discrimination member 311. The discrimination member 311 will be described hereinafter.

The CPU301 is connected with a main assembly memory 312. The main assembly memory 312 is rewritable non-volatile memory and may be integral with the RAM 302.

The CPU301 is connected with a mechanism group X of the first fixing device 150 mounted in the image forming apparatus 100 to effect a temperature adjustment control and fixing element refreshing operation. The mechanism group X includes a temperature sensor 320, a heater 321, a moving mechanism 322, a motor 323, and a refreshing roller moving mechanism 325.

The temperature sensor 320 includes a plurality of temperature sensors provided in the first fixing device 150, including a thermistor 159 (FIG. 3), a thermistor (unshown) for the pressing belt 152.

The heater 321 includes a plurality of heaters provided in the first fixing device 150, including a halogen heater 161 (FIG. 3), a halogen heater (unshown) provided in the heating roller 163.

The CPU301 is connected with a mechanism group X of the second fixing device 170 mounted in the image forming apparatus 100 to effect temperature adjustment control and the fixing element refreshing operation. The mechanism group X for the second fixing device 170 is substantially the same as the mechanism group X of the first fixing device 150, and therefore, the detailed description thereof is omitted by applying the same reference numerals to the corresponding elements. (In the description of the mechanism group X for the first fixing device 150, the first fixing device 150, the pressing belt 152, the heating roller 163 corresponds to the second fixing device 170, the pressing roller 172, the pressing roller 172, respectively).

In this embodiment, the mechanisms are controlled by the CPU301. Alternatively, however, the use can be made with the CPU circuit portions for controlling the respective mechanisms and a main CPU circuit portion connected with the respective CPU circuit portions to effect the overall control.

(3. Image Forming Station)

The image forming apparatus 100 comprises stations 120, 121, 122 and 123 as the image forming station 309 (FIG. 2), an intermediary transfer belt 115 as an intermediary transfer member, and a transfer roller 116 as a transfer portion.

The stations 120, 121, 122, 123 form yellow, magenta, cyan and black toner images, respectively, and transfer the toner images onto the intermediary transfer belt 115.

The structure of the station 120 will be described. A photosensitive drum 110 as the image bearing member is rotatable in the counterclockwise the direction in FIG. 1. A primary charger 111 as a charge portion uniformly charges the surface of the photosensitive drum 110. A laser unit 112 as an exposing portion includes a light source 113 for producing a laser beam to form an electrostatic latent image on the photosensitive drum 110 in accordance with an original image. A developing device 114 as a developing portion develops the electrostatic latent image formed on the photosensitive drum 110 using toner into a toner image. The structures of the stations 121, 122, 123 are the same as the structure of the station 120, and therefore, the description is omitted for the sake of simplicity.

The toner images formed by the stations 120, 121, 122, 123 are transferred onto the intermediary transfer belt 115. The transfer roller 116 transfers the toner images superimposed on the intermediary transfer belt 115 onto the recording material 102 fed from the recording material accommodating portion 103.

(4. Fixing Portion)

(4. 1. Tandem Fixing)

The first fixing device 150 and the Second Fixing Device 170 as the fixing portion fix the toner image transferred onto the recording material 102 By applying heat and pressure to the recording material 102.

The second fixing device 170 is disposed downstream of the first fixing device 150 with respect to the feeding direction of the recording material 102. The second fixing device 170 functions to provide the toner image fixed on the recording material 102 by the first fixing device 150 with glossiness and/or to supplement the heat quantity for a large basis weight recording material (thick sheet, for example) which requires a large amount of heat for the fixing operation.

On the other hand, in the case that the heat by the first fixing device 150 is enough to fix the image, it is unnecessary to use the second fixing device 170, and therefore, the recording material 102 is fed into the feeding path 130 bypassing the second fixing device 170, for the purpose of saving the energy consumption. For example, this occurs in the case that the recording material 102 is plain paper or thin sheet, and high glossiness is not desired. As to whether to feed the recording material 102 into the second fixing device 170 or to feed the recording material 102 bypassing the second fixing device 170 (bypass route), the CPU301 controls it by switching the flapper 131.

(4. 2. Structure of Fixing Device)

The first fixing device 150 and the second fixing device 170 are detachably mountable to the first mounting portion 141 and the second mounting portion 142 (mounting portion) of the image forming apparatus 400, respectively. The first fixing device 150 and a second fixing device 170 can be replaced with the fixing devices having the following structures, respectively.

The first fixing device 150 is provided with a memory 154 as a storing portion. The second fixing device 170 is provided with a memory 174 as a storing portion. The details will be described hereinafter.

In addition, the first fixing device 150 is provided with sensors 153, 155, and the second fixing device 170 is provided with sensors 173, 175. These sensors detect the feeding of the recording material 102. For the respective fixing devices, the upstream sensors 155, 175 with respect to the feeding direction of the recording material 102 function also as detecting portions for detecting the feeding of the recording material 102 to the respective fixing devices. The details will be described hereinafter.

FIG. 3 is a sectional view of an example of a fixing portion. Referring to FIG. 3, the first fixing device 150 will be described in detail.

The first fixing device 150 comprises a fixing roller 151 (fixing member, rotatable member) and a pressing belt 152 (pressing member, rotatable member), which are cooperative with each other to form a nip for fixing the toner image on the recording material 102.

The fixing roller 151 is a hollow roller containing therein a halogen heater 161 as a heating source. The thermistor 159 as a temperature detecting portion is a sensor for sensing a temperature of the fixing roller 151. The CPU301 ON/OFF-controls the halogen heater 161 on the basis of the information of the temperature detected by the thermistor 159. This is done to adjust and maintain the temperature of the fixing roller 151 at a predetermined temperature. The predetermined temperature includes a tolerance.

The pressing belt 152 is an endless belt stretched around the three rollers. To the inner surface of the pressing belt 152, a pressing pad 164 is contacted to urge the pressing belt 152 toward the fixing roller 151. The heating roller 163 which is one of the three rollers is a hollow roller, and contains therein a halogen heater (unshown) as the heating source. Similarly to the fixing roller 151, for the pressing belt 152, CPU301 controls the halogen heater (unshown) in the heating roller 163 on the basis of detected temperature information by the thermistor (unshown) for sensing the temperature. As a result, the temperature of the pressing belt 152 is maintained as to a predetermined temperature.

The fixing roller 151 is rotated by a motor 323 (FIG. 2) as a driving source to feed the recording material 102 in the direction indicated by an arrow An in FIG. 3. The pressing belt 152 is rotated by the fixing roller 151.

The first fixing device 150 is provided with a moving mechanism 322 (FIG. 2) for moving the pressing belt 152 to provide a contact state in which the fixing roller 151 and the pressing belt 152 contact with each other to form the nip and a spaced state in which they are spaced.

On the other hand, the second fixing device 170 includes the pressing roller 172, not a pressing belt, as the pressing member, and the fixing roller 171 (fixing member) and the pressing roller 172 (pressing member) form a nip for fixing the toner image on the recording material 102 (FIG. 1). The pressing roller 172 is a hollow roller, and contains therein a halogen heater (unshown) as a heating source. The pressing roller 172 is provided with a thermistor (unshown) as a temperature sensor. The CPU301 controls the thermistor and the halogen heater (unshown), so that the temperature of the pressing roller 172 is maintained at a predetermined temperature.

The above-described structures of the second fixing device 170 are similar to those of the first fixing device 150, and therefore, the description of the structures of the second fixing device 170 will be omitted for the sake of simplicity.

In the following description, the first fixing device 150 will be taken, and the description also applies to the second fixing device 170 unless otherwise stated. (the structures of the first fixing device 150 apply to the structures of the second fixing device 170).

In this embodiment, the structures of the pressing sides of the first fixing device 150 and the second fixing device 170 are different from each other, but they may be the same. More particularly, the pressing side structures of the first fixing device 150 and the second fixing device 170 may use pressing belts or pressing rollers. Alternatively, the pressing side may comprise the pressing roller in the first fixing device 150, and the pressing side may comprise a pressing belt in the second fixing device 170.

(4. 3. Refreshing Roller)

The description will be made as to a refreshing roller 156 as a rubbing rotatable member for effecting a rubbing treatment for the surface of the rotatable member. The description will be made taking the rubbing treatment surface of the fixing roller 151 of the first fixing device 150. The following description is applied also to the second fixing device 170.

In this embodiment, the refreshing roller 156 effects the rubbing treatment of the surface of the fixing roller 151. The refreshing roller 156 is capable of moving to contact to or to space from the fixing roller 151, and is capable of rubbing the peripheral surface of the fixing roller 151. The refreshing roller 156 comprises abrasive grain fixed on the peripheral surface thereof. The refreshing roller 156 is a roughening roller which is rotated at a peripheral speed which is different from that of the fixing roller 151, so that the peripheral surface of the fixing roller 151 is roughened.

More particularly, the refreshing roller 156 comprises a stainless steel pipe (SUS304) (base material) having an outer diameter of 12 mm, and a rubbing layer on the peripheral surface with a bonding layer therebetween, the rubbing layer including abrasive grain bonded at a high density.

The rubbing layer can be provided by bonding various commercially available abrasive grains or a mixture thereof on the bonding layer. The examples of the material of the commercially available abrasive grain includes aluminum oxide, aluminum hydroxide oxide, silicon oxide, cerium oxide, titanium oxide, zirconia, lithium silicate, silicon nitride, silicon carbide, iron oxide, chromium oxide, antimony oxide, diamond or the like.

In this embodiment, the abrasive grain of the rubbing layer is abrasive grain of aluminum oxide (alumina abrasive grain, Alundum, Molundum). The abrasive grain of aluminum oxide is most widely used, and has sufficient hardness as compared with the fixing roller 151, and in addition, the particles have acute angles, and therefore, the abrasive grain of aluminum oxide is preferable for the rubbing layer. In order that the rubbing treatment of the refreshing roller 156 performs the sufficient fixing element refreshing operation to provide the surface roughness of the fixing roller 151, the particle size of the abrasive grain of the rubbing layer is preferably not less than 5 μm and not more than 20 μm, as a result of the experiments which will be described hereinafter.

The refreshing roller 156 is movable between a contact state position in which it contacts the fixing roller 151 and a spaced state position in which it is spaced from the fixing roller 151, by a refreshing roller moving mechanism 325. The CPU301 controls the refreshing roller moving mechanism 325 to control the state (contacting-spacing) of the refreshing roller 156.

The refreshing roller 156 is driven by a motor 324 as a driving source with a peripheral speed difference relative to the fixing roller 151. The CPU301 controls the motor 324 for the refreshing roller to control rotating and stopping of the refreshing roller 156. The peripheral speed difference of the refreshing roller 156 may be provided by moving to the peripheral surface thereof in the same or opposite peripheral moving direction relative to the surface of the fixing roller 151.

The refreshing roller 156 is rotated by the motor 324 while being in contact with the fixing roller 151 by the refreshing roller moving mechanism 325 to rub the peripheral surface of the fixing roller 151.

The CPU301 controls the refreshing roller moving mechanism 325 and the motor 324 for the refreshing roller to cause the refreshing roller 156 to rub the fixing roller 151 rubbing treatment, fixing element refreshing operation). The fixing element refreshing operation is to improve the surface state of the fixing roller 151 to provide an even surface state of the peripheral surface of the fixing roller 151 with respect to the longitudinal direction. The detail of the fixing element refreshing operation will be described.

(5. Fixing Device Exchanging System)

The exchanging system of the fixing device will be described.

The image forming apparatus 100 is capable of printing on various kinds and sizes of the recording material 102. In order to provide high quality prints, in the image forming apparatus 100 of this embodiment, the fixing device can be exchanged depending on the kinds of the recording material 102 or the preference of the operator.

For example, this is the case that the fixing device to be used when the recording material 102 is an envelope and the fixing device to be used when another material are different from each other. When the recording material 102 is an envelope, the fixing device exclusively for the envelope is used. The envelope is easily creased by the pressure applied during the fixing process. Therefore, it is desirable to use a fixing device adjusted in the pressure between the fixing roller 151 and the pressing belt 152 (nip pressure) particularly for envelopes.

The same applies to the second fixing device 170.

Thus, according to the image forming apparatus 100 of this embodiment, the operator can exchange the fixing device depending on the kinds of the recording materials 102 or preferences of the operator.

When the fixing device is exchanged, the operator opens the front door 140 to take the mounted fixing device out of the image forming apparatus 100. Then, the operator mounts another fixing device into the image forming apparatus 100, and closes the front door 140. In this embodiment, the first fixing device 150 and the second fixing device 170 are exchangeable, respectively.

(6. Glossiness Unevenness at the Widthwise End Portion of the Recording Material)

The preferability of the fixing element refreshing operation will be described.

The fixing roller 151 comprises a base layer of aluminum having an outer diameter of 68 mm, and an elastic layer of silicone rubber thereon having a rubber hardness of 20° (JIS-A under 1 kg load) and having a thickness of approx. 1.0 mm. The surface of the elastic layer is coated with a parting layer of fluorine resin tube having a thickness of 30 μm.

In the image forming operation of the image forming apparatus 100, the first fixing device 150 forms a nip between the fixing roller 151 and the pressing belt 152.

In the case that the toner having a high melting property is used in the oil-less fixing type device, as in this embodiment, the surface state of the fixing roller 151 tends to be reflected on the surface of the toner layer. In other words, fine pits and projections of the surface of the fixing roller 151 tend to appear on the surface of the output image. Such a property is called reflection property. When the reflection property becomes high as a result of enhancement of the melting property of the toner, it is important to maintain the surface state of the fixing roller 151 from the standpoint of forming an image of the high image quality with high glossiness.

Figure 5:
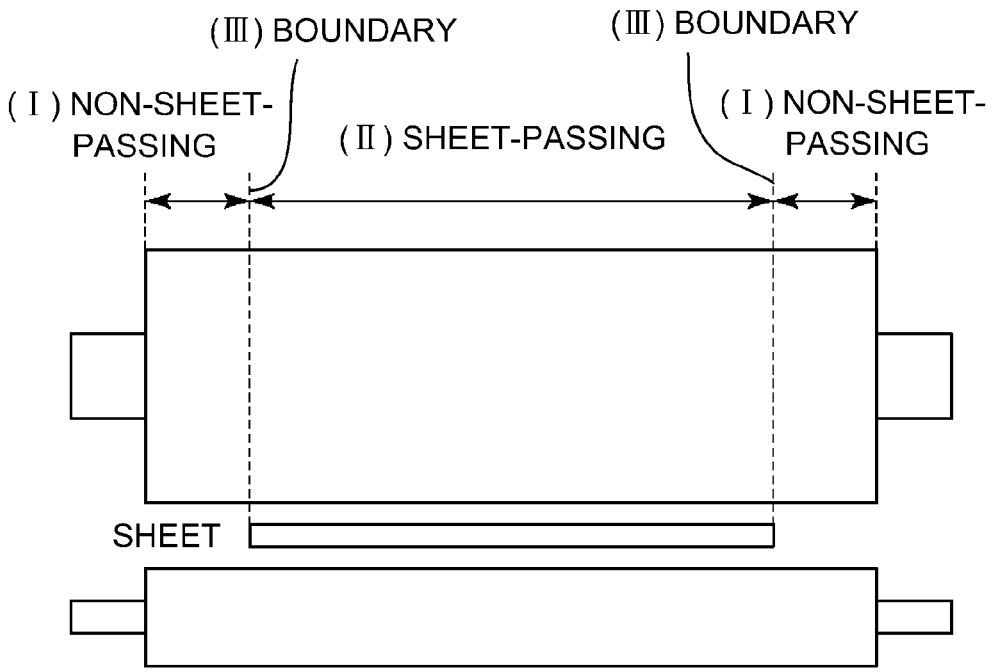
FIG. 5 illustrates a state in which the fixing portion nips and feeds a recording material.

FIG. 5 illustrates a state in which the fixing portion nips and feeds a recording material.

Figure 6:
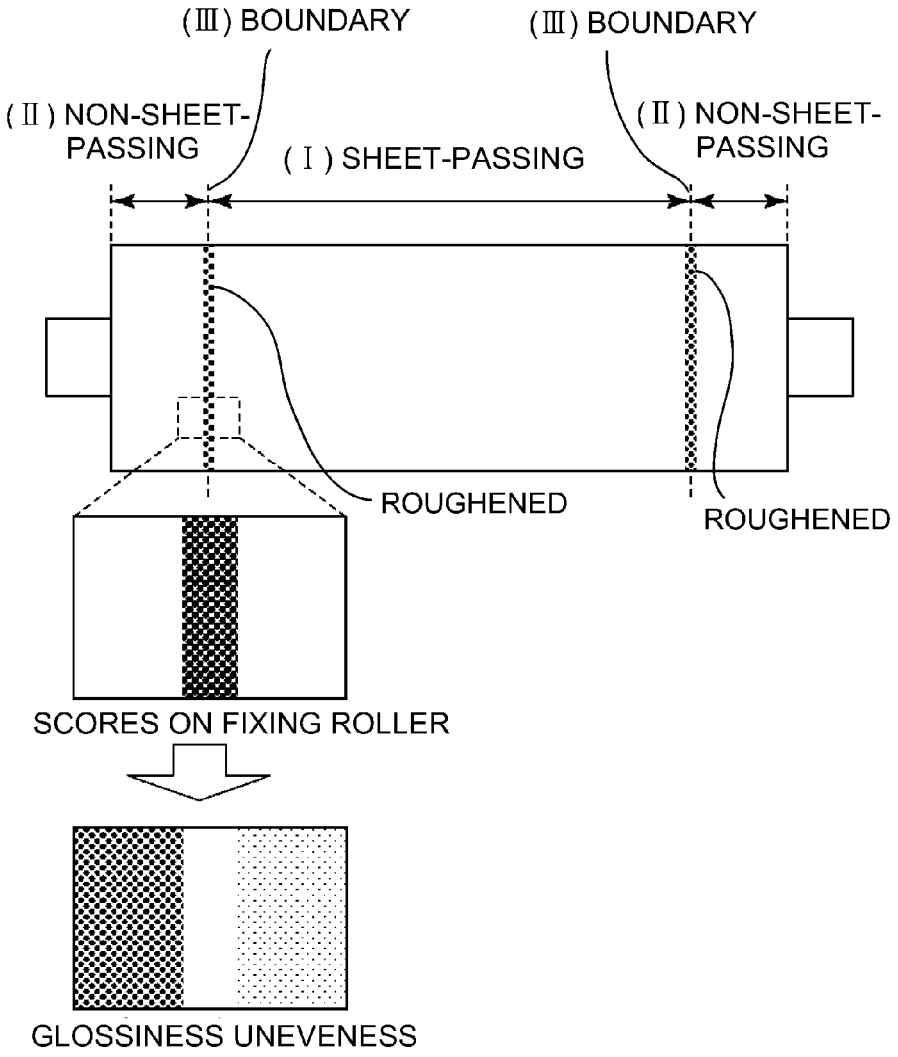
FIG. 6 illustrates glossiness unevenness at the edge of the recording material.

FIG. 6 illustrates glossiness unevenness at the edge of the recording material. The fixing roller 151 in the initial state has a uniform specular-surface state over the entirety of the peripheral surface. At this time, the surface roughness of (ten point average roughness) Rz of the peripheral surface is about 0.1 μm-0.3 μm. The surface roughness Rz is a ten point average roughness (JIS) measured using a surface roughness measuring device SE-3400 available from Kabushiki Kaisha KOSAKA Kenkyusho, Japan. As the measuring condition, the feeding speed is 0.5 mm/sec, the cut-off level is 0.8 mm, and measurement length is 2.5 mm.

The fixing process operation of the first fixing device 150 on the recording material 102 is repeated, the surface state of the fixing roller 151 gradually changes due to the contact to the end portions of the recording material 102, the paper dust, the offset toner or the like, and therefore, the surface of the fixing roller 151 is gradually roughened. By the recording materials 102 passing the same position with respect to the direction of the rotational axis of the fixing roller 151, the degrees of the roughness of the fixing roller 151 are different between (I) non-passing portion, (II) passing portion and (III) boundary area there between.

The end portion of the recording material 102 is the end portion with respect to a direction perpendicular to the feeding direction of the recording material 102, and is called edge portion.

The (I) non-passing portion is the area in which no sheet passes, and therefore, is not contacted by the recording material 102. In the (I) non-passing portion, the surface of the fixing roller 151 contacts only the surface of the pressing belt 152.

In the (II) passing portion, the recording material 102 passes, and therefore, is contacted by the recording material 102. In the (II) passing portion, the surface of the fixing roller 151 is gradually roughened by the contact with fibers of the recording material 102, loading material of the recording material 102, externally added material of the developer on the recording material 102. The (III) boundary area between the passing portion and the non-passing portion is repeatedly contacted by the edge portion of the recording material 102, and therefore, the surface roughness is higher than that in the (II) passing portion. FIG. 6 shows the roughened surface at the area corresponding to the (III) boundary area of the fixing roller 151, produced by the edge portions of the recording materials 102.

In the process of fixing the toner image on the recording material 102, the fine surface shape of the fixing roller 151 is transferred onto the surface of the fixed image.

As shown in FIG. 6, if the surface states of the fixing roller 151 are different between the (II) passing portion and the (III) boundary area, the surface state of the fixed image is not even, and therefore, the fix the image exhibits a glossiness unevenness. The width of the (III) boundary area is as small as approx. 1-2 mm, and the glossiness difference between the (I) non-passing portion and the (II) passing portion is remarkable because the glossiness unevenness is in the wide range.

The glossiness unevenness of the fixed image is dependent also on the kind of paper of the recording material 102. For example, the glossiness unevenness which is not visible on the plain paper is remarkable on the gloss coated paper sheet having a high glossiness with which a high image quality is required because of the high smoothness of the surface. In the fixed image on the gloss coated paper sheet, a low glossiness stripe is remarkable at the position corresponding to the (III) boundary area (rougher than the other area) of the fixing roller 151, and the glossiness difference between the (I) non-passing portion and the (II) passing portion. Therefore, the glossiness unevenness on the fixed image is remarkable as a whole.

By the difference in the roughness of the surface of the fixing roller 151 between the (I) non-passing portion and the (II) passing portion as described above results in the difference in the glossiness on the fixed image. Particularly, the (III) boundary area tends to be roughened and provides the glossiness difference relative to the (I) non-passing portion and the (II) passing portion.

In the foregoing, the description has been made with respect to the first fixing device 150, but the same applies to the second fixing device 170, and therefore, the description is omitted for the second fixing device 170.

The fixing element refreshing operation improves the surface state of the fixing roller 151 to prevent glossiness unevenness attributable to the difference in the roughness of the surface of the fixing roller 151.

On the other hand, a user may not require the fixing element refreshing operation.

The reason why the fixing element refreshing operation is necessitated is, as described hereinbefore, to suppress the glossiness unevenness of the image attributable to the difference in the surface roughness between the (I) passing portion, the (II) non-passing portion, the (III) boundary area.

The likelihood that the difference in the surface roughness of the fixing roller 151 arises when the recording material 102 having a width over the (I) passing portion, the (II) non-passing portion and the (III) boundary area is passes through the nip. For example, this is the case when an A3 size recording material is passed after A4 size recording materials 102 are continuously passed therethrough. In such a case, the edge portions of the recording material 102 (longitudinal feeding) are the (III) boundary area, and the difference in the surface roughness between the (I) passing portion, the (II) non-passing portion and the (III) boundary area is likely to be reflected on the image surface of the A3 recording material 102.

That is, in the case that only the same width size recording materials 102 are passed through the nip, the glossiness unevenness would not arise. Therefore, the glossiness unevenness can be avoided by using, as the first fixing device 150, different fixing devices having the same structures for the respective width sizes of the recording materials 102. Quite frequently, the users who are concerned with the glossiness property use different fixing devices depending on the width sizes of the recording materials 102 to avoid the deterioration of the print quality.

In such a case, that is, the glossiness unevenness caused by the edge portions of the recording materials 102, it is desirable not to execute the fixing element refreshing operation to avoid the fine scores provided by the refreshing roller 156 influences the glossiness property of the image.

(7. Fixing Roller Refreshing Operation Setting)

The description will be made as to the structure for the use to select the execution and the non-execution of the fixing element refreshing operation for each fixing device which is replaceably usable.

The description will be made as to the first fixing device 150, but the same applies to the second fixing device 170.

The operating portion 180 functions as a setting portion for setting the permission or prevention of the execution of the fixing element refreshing operation (fixing element refreshing operation setting) by the operator. The operating portion 180 is provided with a selector for displaying the setting screen for setting the permission or prevention of the execution of the fixing element refreshing operation. When the setting once selected by the operator is changed, the operating portion 180 is used.

Figure 7:
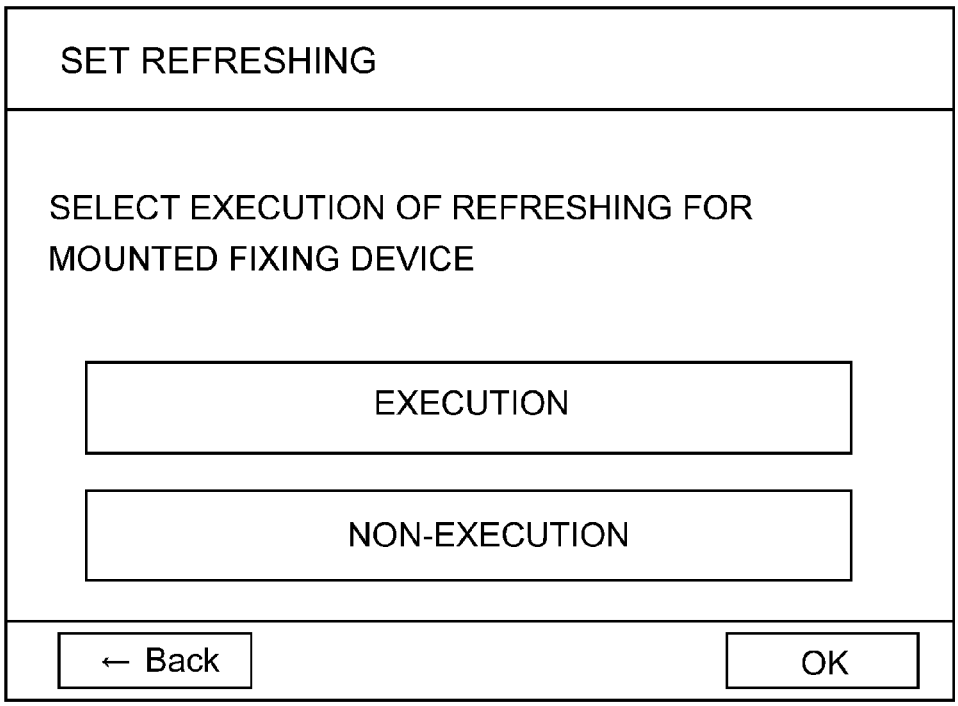
FIG. 7 illustrates an example of a display screen and which a fixing element refreshing operation can be set.

When the selector for displaying the setting screen is selected by the operator, the operating portion 180 as the setting portion displays the selection screen shown in FIG. 7. FIG. 7 illustrates an example of a display screen and which a fixing element refreshing operation can be set.

The operator sets the permission or prevention of the execution of the fixing element refreshing operation through the operating portion 180. More particularly, when the execution of the fixing element refreshing operation for the first fixing device 150 is permitted, the operator selects "permit fixing element refreshing operation". On the other hand, when the execution of the fixing element refreshing operation is not permitted, the operator selects "not permit fixing element refreshing operation". The setting may be carried out using a selection key or keys provided in the operating portion 180 or by touching a display portion of the operating portion 180 if it is a touch panel type.

(8. Memory of the Fixing Device)

In this embodiment, the CPU301 records the information indicative of the permission or prevention of the fixing element refreshing operation for the first fixing device 150 selected on the operating portion 180, in the memory 154 of the first fixing device 150.

In this embodiment, the fixing device is exchangeable, and therefore, the first fixing device 150 is provided with a memory 154 as a storing portion, and the second fixing device 170 is provided with a memory 174 as a storing portion. In this embodiment, the fixing device is exchangeable, and therefore, the first fixing device 150 is provided with a memory 154 as a storing portion, and the second fixing device 170 is provided with a memory 174 as a storing portion. The memories 154, 174 are rewritable non-volatile memory (storing portion), typically such as an EEPROM, a flash memory or the like. A memory is also provided on a fixing device (not the first fixing device 150 or the second fixing device 170 already mounted in the image forming apparatus 100) kept outside of the image forming apparatus 100.

The fixing device group including the first fixing device 150 and the second fixing device 170 is provided with the memory in order to solve the problem described below. The problem arises when the first and/or second fixing device is once taken out of the apparatus 300, and then the fixing device is remounted in the image forming apparatus 300 The following description will be made taking the first fixing device 150 as an example, but the same applies to the second fixing device 150. The following description is applied also to the second fixing device 170.

More particularly, the following situation may occur. That is, the fixing device to be replaced is the first fixing device 150.

For example, suppose that fixing element refreshing operation it carried out after 500 recording materials 102 are fed in the case that the fixing element refreshing operation is permitted. Further, a fixing device A not for a particular width size, and a fixing device B exclusively for the particular width size are usable for the first fixing device 150. It is further assume that the operator likes to permit the execution of the fixing element refreshing operation for the fixing device A, but does not like to permit the execution of the fixing element refreshing operation for the fixing device B.

When the fixing device A not for a particular width size is mounted in the main assembly as the first fixing device 150, the operator sets the "permit fixing element refreshing operation" through the operating portion 180. Then, the fixing element refreshing operation is automatically executed for the fixing device A, after 500 recording materials are fed. Someday later, when the printing using the fixing device B exclusively for the particular width size recording materials is necessary, the operator takes the fixing device A out of the image forming apparatus 100 to mount the fixing device B in the main assembly.

Conventionally, the CPU controls the execution and non-execution of the fixing element refreshing operation by the management of the setting about the execution and non-execution of the fixing element refreshing operation in the memory which is provided in the main assembly of the image forming apparatus and which stores the number of recording materials supplied to the first fixing device. If the fixing device B simply replaces the fixing device A, the setting on the fixing device A keeps valid, and therefore, the fixing element refreshing operation may be executed for the fixing device B. In the case that the setting about the execution or non-execution of the fixing element refreshing operation is desired to be peculiar to the fixing device, the setting has to be changed for each of the exchanging operations of the fixing device. More particularly, when the operator changes to use the fixing device B exclusively for a particular width size, the printing job is carried out after setting the non-execution of the fixing element refreshing operation. In addition, when the operator uses the fixing device A not exclusive for the particular recording materials, the operator replaces the fixing device A with the fixing device B, and sets the execution of the fixing element refreshing operation, and then the printing job is carried out.

It is cumbersome for such a user to effect the setting about the fixing element refreshing operation each time the fixing device is replaced. Thus, the usability is deteriorated.

In this embodiment, the memory 154 is provided in the first fixing device 150 to avoid such cumbersome setting. By doing so, the first fixing device 150 and the replacement fixing device can store and the information indicative of the execution or non-execution of the fixing element refreshing operation set on the operating portion 180.

Figure 8:
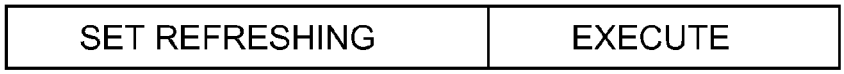
FIG. 8 illustrates an example of information stored in a memory of a fixing device.

As shown in FIG. 8, for example, the CPU301 stores the information indicative of whether or not the fixing element refreshing operation is to be executed (set information) in the memory 154 of the first fixing device 150 mounted in the image forming apparatus 100. More particularly, when the operators selects the "execution of fixing element reflecting operation" on the operating portion 180, the "execution" is stored in the memory 154 as the information indicative of the permission of the execution of the fixing element refreshing operation. When the operator selects "non-execution of fixing element refreshing operation", the "non-execution" stored in the memory 154 as the information is indicative of non-permission of the execution of the fixing element refreshing operation. The method for storing information in the memory 154 is not limited to the above-described a method, but any method is usable if the execution or non-execution of the fixing element refreshing operation is indicated for the first fixing device 150. FIG. 8 illustrates an example of the information stored in the memory of the fixing device.

With the remounting of the first fixing device 150 by the operator, the CPU301 acquires the set information from the memory 154.

When the first fixing device 150 is to be exchanged, the operator opens the front door 140, and draws the first fixing device 150 out of the image forming apparatus 100 and then exchanges the fixing device. Then, the first fixing device 150 is moved in the opposite direction to set it in the image forming apparatus 100, and the front door 140 is closed.

The CPU301 detects that the front door 140 is closed, on the basis of the signal from the opening and closing sensor 305. Upon the detection of the closure of the front door 140, the CPU301 accesses the memory 154 of the first fixing device 150. By this, it is confirmed that the first fixing device 150 is mounted. If the CPU301 is unable to access the memory 154, the CPU301 discriminates that the first fixing device 150 is not mounted. The method for discriminating whether or not the first fixing device 150 is mounted is not limited to that described above, and may be discriminated by electrical conduction or non-conduction state between the image forming apparatus 100 and the first fixing device 150, for example.

If the fixing device is exchanged in the OFF-state of the main switch 101, the opening and closing sensor 305 is unable to detect in the closure of the front door. Therefore, the CPU301 accesses the memory 154 of the first fixing device 150 in response to the actuation of the main switch 101. By this, it is confirmed that the first fixing device 150 is mounted. If the CPU301 is unable to access the memory 154, the CPU301 discriminates that the first fixing device 150 is not mounted.

The CPU301 controls the fixing element refreshing operation on the basis of the set information acquired from the memory 154 upon the remounting of the first fixing device 150. More particularly, when the set information stored in the memory 154 indicates "execution", the execution of the fixing element refreshing operation is permitted, and if the set information stored in the memory 154 indicates "non-execution", the execution of the fixing element refreshing operation is prohibited.

(9. Fixing Roller Refreshing Operation)

The description will be made in detail as to the fixing element refreshing operation (fixing element refreshing operation) when the memory of the fixing device indicates "execution".

As described in the foregoing, when the recording materials 102 pass through the nip repeatedly, the unevenness of the surface state is produced in the longitudinal direction of the fixing roller 151 (the direction of the rotational axis).

The CPU301 executes the fixing element refreshing operation for improving the surface state of the fixing roller 151 when the number of the recording materials 102 fed to the first fixing device 150 exceeds the predetermined number. In this embodiment, the CPU301 counts the feeding number of the recording materials 102 on the RAM 302 for each width size. The fixing element refreshing operation is carried out when a count of any one of the feeding numbers for all of the width sizes exceeds the predetermined number. In the following, the description will be made taking the first fixing device 150 as an example, and the same applies to the second fixing device 170, and therefore, the description about the second fixing device will be omitted in this respect.

The refreshing roller 156 rubs the fixing roller 151 in the fixing element refreshing operation. By this, the surface roughness of the fixing roller 151 is made in the form in the longitudinal direction, thus improving the surface state of the fixing roller 151.

The refreshing roller 156 provides the portion of the surface of the fixing roller 151 roughened by the passing of the recording materials 102 and the portion of the surface relatively less roughened with a great number of fine scores, to a predetermined level. That is, the refreshing roller 156 decreases the difference in the surface state of the entirety of the fixing roller 151.

By this, the low glossiness stripe on the image at the position corresponding to the edge portion ((III) boundary area) and the glossiness difference between the (I) non-passing portion and the (II) passing portion are reduced.

Thus, the surface state of the fixing roller 151 can be improved. By providing the surface of the fixing roller 101 with the great number of fine scores by the refreshing roller 156, the scores are difficult to see on the image. That is, by superimposing the fine scores on the portion roughened by the end portion of the recording material 102, using the refreshing roller 156, the damage on the fixing roller 151 produced by the end portion of the recording materials 102 does not visibly appear on the recording material 102.

The intended function of the refreshing roller 156 is to provide the surface of the fixing roller 151 with the fine scores, not to scrape the surface of the fixing roller 151. That is, the refreshing roller 156 provides the surface with the scores substantially without scraping the surface of the fixing roller 151. The rubbing by the refreshing roller 156 does not abrade the surface of the fixing roller 151, and is as if it imprints the surface into the initial state.

After the execution of the fixing element refreshing operation, the CPU301 clears the count for all of the width sizes on the RAM 302. The fixing element refreshing operation is carried out when a count of any one of the feeding numbers for all of the width sizes exceeds the predetermined number, again.

(10. Stand-by Mode)

The stand-by mode means the state in which the image forming apparatus 100 is in the state capable of starting of the image forming operation and waits for the printing instructions (printing job) by the operator. The operating portion 180 receives the printing job including the kind (surface property, basis weight, size or the like) of the recording material 102 on which the image is to be formed, the number of prints, one-side printing/both side printing.

When the main switch 101 of the image forming apparatus 100 is actuated, the image forming apparatus 100 carries out preparing operations (start-up operations) for the preparation for the image forming operation for the respective parts of the image forming apparatus 100 such as the first fixing device 150, the second fixing device 170 and the image forming station 309. In the case that no printing job to start even after the image forming operation of the image forming apparatus 100 is enabled (that is, the start-up operations are completed), or that the execution of the printing job is completed, the image forming apparatus 100 shifts to the stand-by mode.

When the image forming apparatus 100 is enabled to start the image forming operation, the CPU301 displays "printable" on the operating portion (notifying portion) 180.

In this embodiment, in the stand-by mode, the temperature control for the first fixing device 150 and the second fixing device 170 (the fixing roller 151 and pressing belt 152, for example) is continued so that the printing operation can be started as soon as the printing job is received.

If a printing operation is reserved during the start-up operation, the reserved printing job is executed without entering the stand-by mode.

If sheet jamming occurs during the execution of the printing job, for example, the image forming apparatus 100 stops the operation and interrupts the printing job. In such a case, the start-up operation is carried out to enable the image forming operation of the image forming apparatus 100 after the jammed sheet is cleared. When the job is resumed at the interruption, the apparatus does not enter the stand-by mode, and restart the job immediately after the completion of the start-up operation.

(11. Control Flow)

FIGS. 9-12 show flow charts of the control operation when the first fixing device 150 having the memory 154 indicative of the execution or non-execution is used. The operations indicated in the flow charts are carried out under the control of the controller (recording portion) functioning as the CPU301 controlling various mechanisms of the image forming apparatus 100 on the basis of the control program stored in the ROM 303. The description will be made as to the first fixing device 150, but the same applies to the second fixing device 170.

(11. 1. Setting Sequence)

Figure 9:
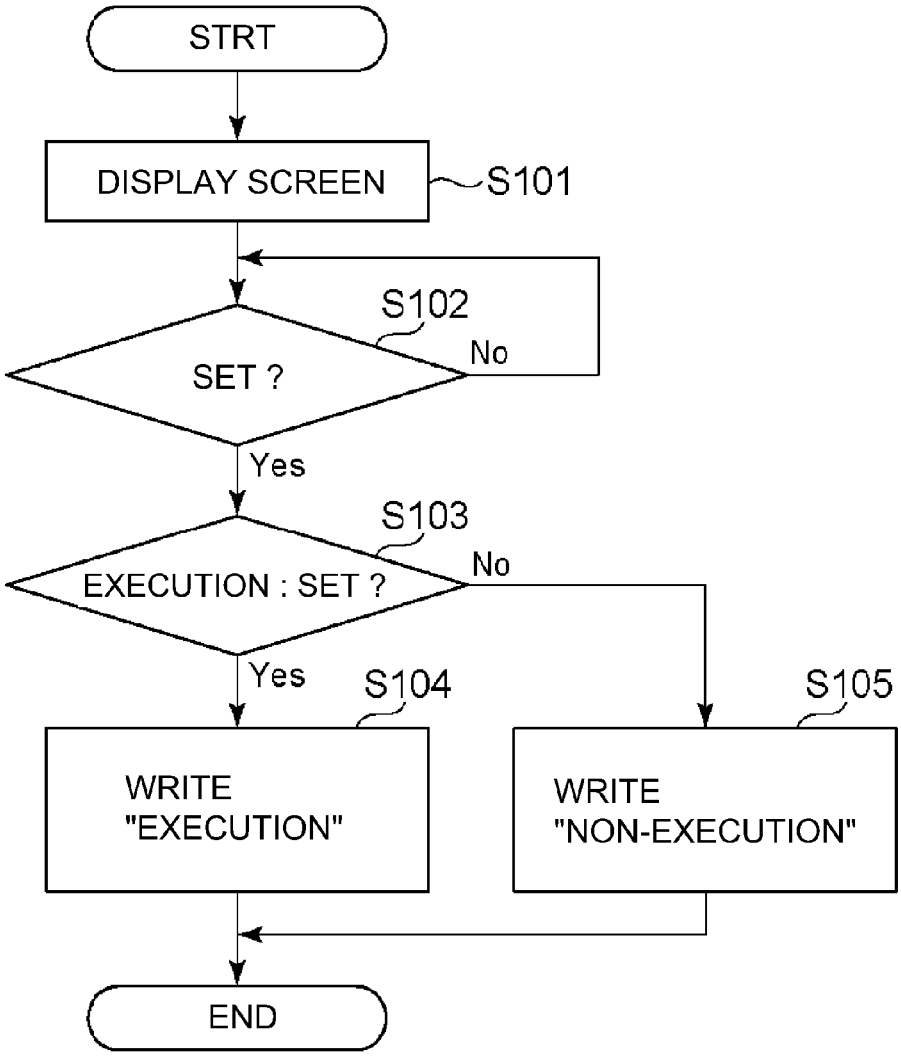
FIG. 9 is a flow chart of a setting sequence.

FIG. 9 is a flow chart of a setting sequence. In this embodiment, the default setting indicative of the mission of the fixing element refreshing operation is pre-stored in the memory 154. The operator can change the setting using the setting sequence of FIG. 9 depending on usage or the preference of the operator. The default setting may be non-execution of the fixing element refreshing operation. However, the default setting is preferably the permission of the fixing element refreshing operation, because it is supposed that one fixing device is used for a plurality of width sizes of the recording materials 102, unless the user wants to use different fixing devices for different width sizes.

When the operator selects the selector for displaying the setting screen of the operating portion 180, the CPU301 displays the setting screen for setting the permission or prohibition of the fixing element refreshing operation on the operating portion 180 (S101). More particularly, as shown in FIG. 7, for example, the screen prompting the setting is shown.

The CPU301 waits for the setting of the operator, and when the setting indicative of whether to permit the fixing element refreshing operation is carried out, the operation proceeds to S103 (S102). The CPU301 acquires and the event of the setting and the content of the setting on the basis of the signal from the operating portion 180.

When the permission of the fixing element refreshing operation is set by the operator (S103, Yes), the CPU301 proceeds to step S104 to write "execution" of the fixing roller refreshing operation in the memory 154 (S104). That is, the CPU301 records the information indicative of permission of the fixing element refreshing operation as the set information.

When the prohibition of the fixing element refreshing operation is set by the operator, the CPU301 proceeds to step S105 (S103, No) to write "non-execution" of the fixing roller refreshing operation in the memory 154 (S105). That is, the CPU301 records the information indicative of prohibition of the fixing element refreshing operation as the set information.

(11. 2. Sequence Upon Actuation of the Main Switch and Upon Closing the Front Door)

Figure 10:
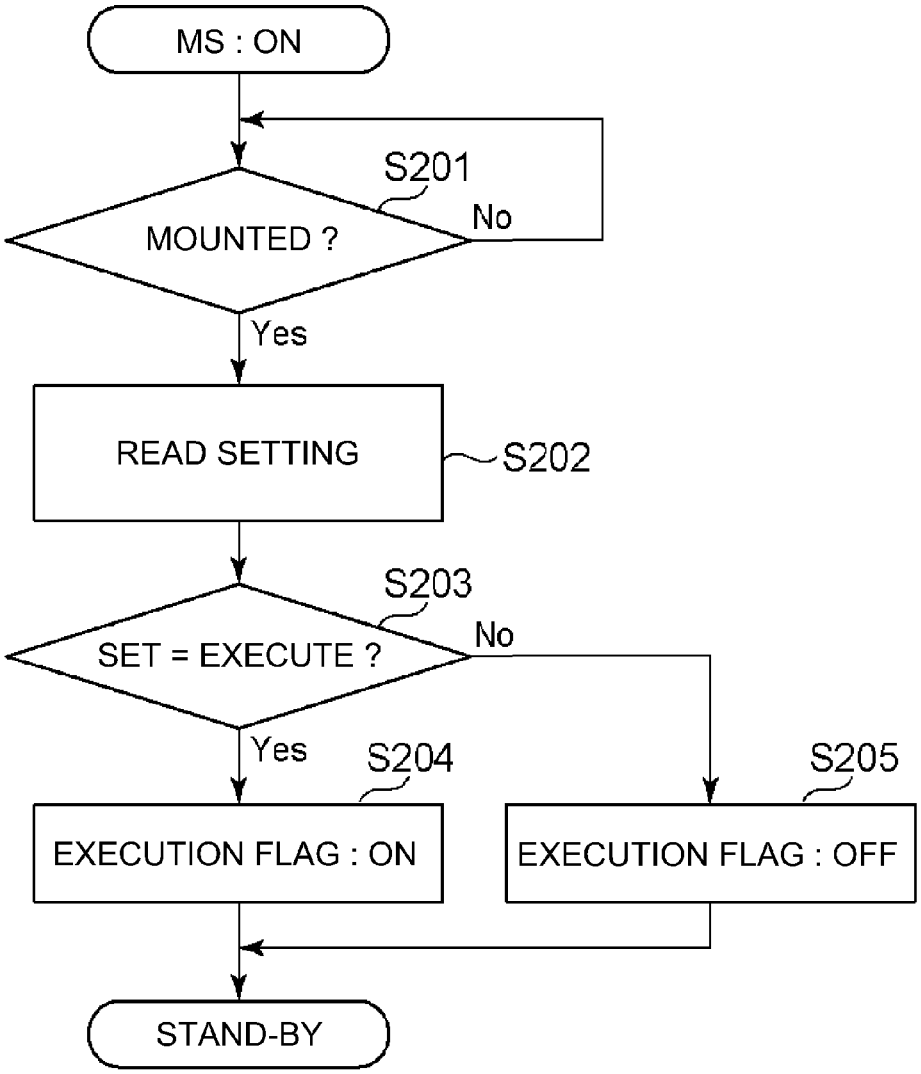
FIG. 10 is a flow chart showing the operations from the actuation of a main switch to a stand-by mode.

FIG. 10 is a flow chart showing the operations from the actuation of a main switch to a stand-by mode.

Upon the actuation of the main switch 101 by the operator, the CPU301 starts. The CPU301 discriminates whether or not the first fixing device 150 is mounted in the image forming apparatus 100 (S201). If the result of the discrimination is affirmative, the CPU301 becomes accessible to the memory 154. If the result of the discrimination at the step (S201) is negative, the operation returns to the step S201. In such a case, the CPU301 may display a message prompting the insertion of the first fixing device 150, on the operating portion 180. If the first fixing device 150 is mounted in the image forming apparatus 100, the operation proceeds to the step S102.

The CPU301 reads the fixing element refreshing operation setting (set information) out of the memory 154 (S202).

When the fixing element refreshing operation setting acquired in the step S203 indicates "execution" the operation proceeds to S204 (S203, Yes). In the step S204, the CPU301 renders ON the flag of the fixing element refreshing operation and sets it on the RAM 302.

When the fixing element refreshing operation setting acquired in the step S203 indicates "non-execution" the operation proceeds to S205 (S203, No). In the step S205, the CPU301 renders OFF the flag of the fixing element refreshing operation and sets it on the RAM 302.

Then, the CPU301 proceeds to the stand-by mode.

Figure 11:
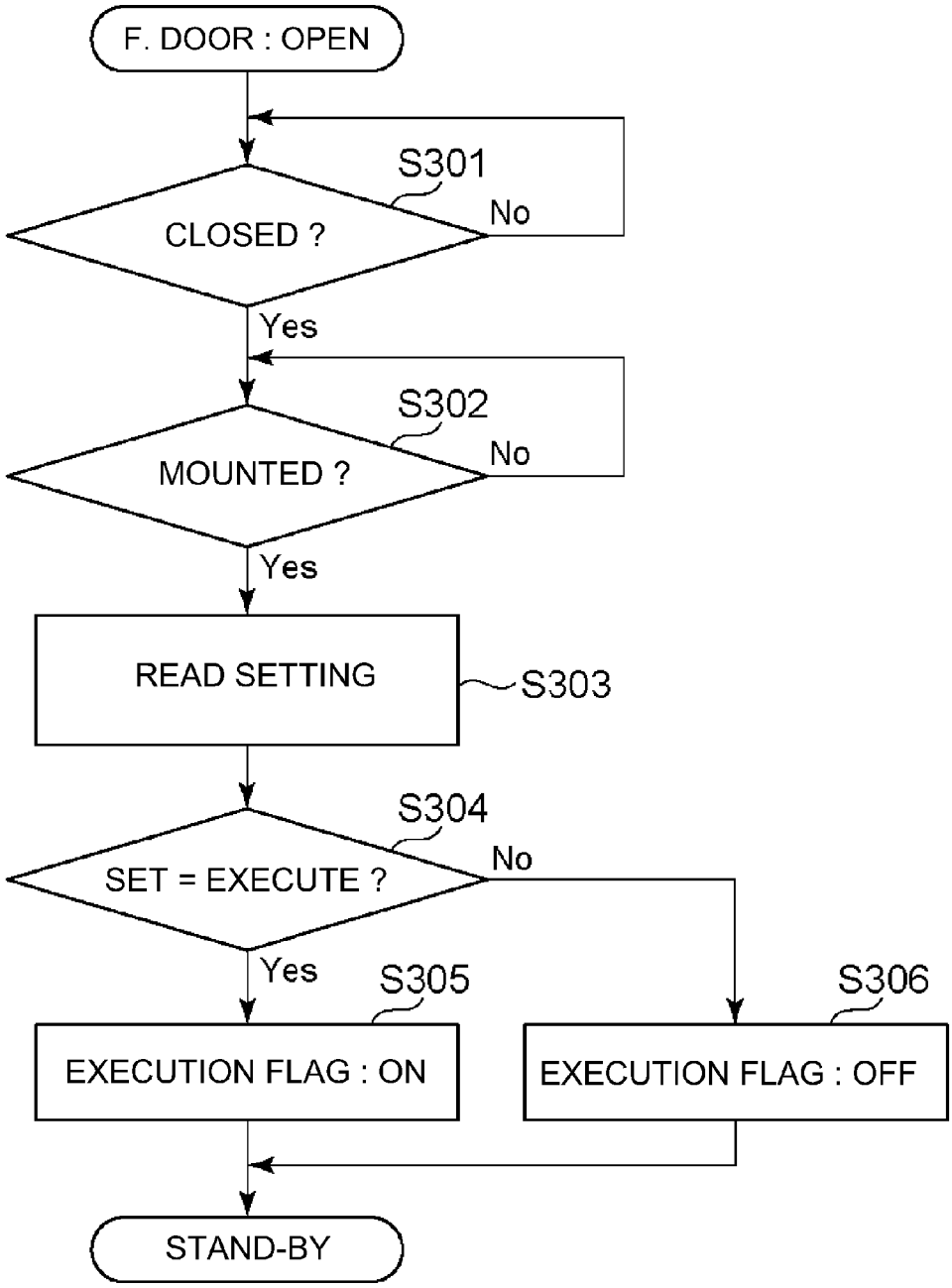
FIG. 11 is a flow chart showing the operations from the state in which a front door is open to the stand-by mode.

FIG. 11 is a flow chart showing the operations from the state in which a front door is open to the stand-by mode.

The opened and closed states of the front door 140 are detected by the CPU301 on the basis of the signal from the opening and closing sensor 305 of the front door 140. When the front door 140 is open, the CPU301 waits for the closing of the front door 140 (S301). When the front door 140 is open, the CPU301 may display information to prompt to close the front door 140. When the CPU301 detects the closing of the front door 140 (S301), the operation proceeds to step S302.

The steps S302-S306 are the same as the steps S201-S205, respectively of FIG. 10, and therefore, the description thereof is omitted. After the step S306, the operation proceeds to the stand-by mode.

(11. 3. Sequence as to Whether to Execute Fixing Element Refreshing Operation)

Figure 12:
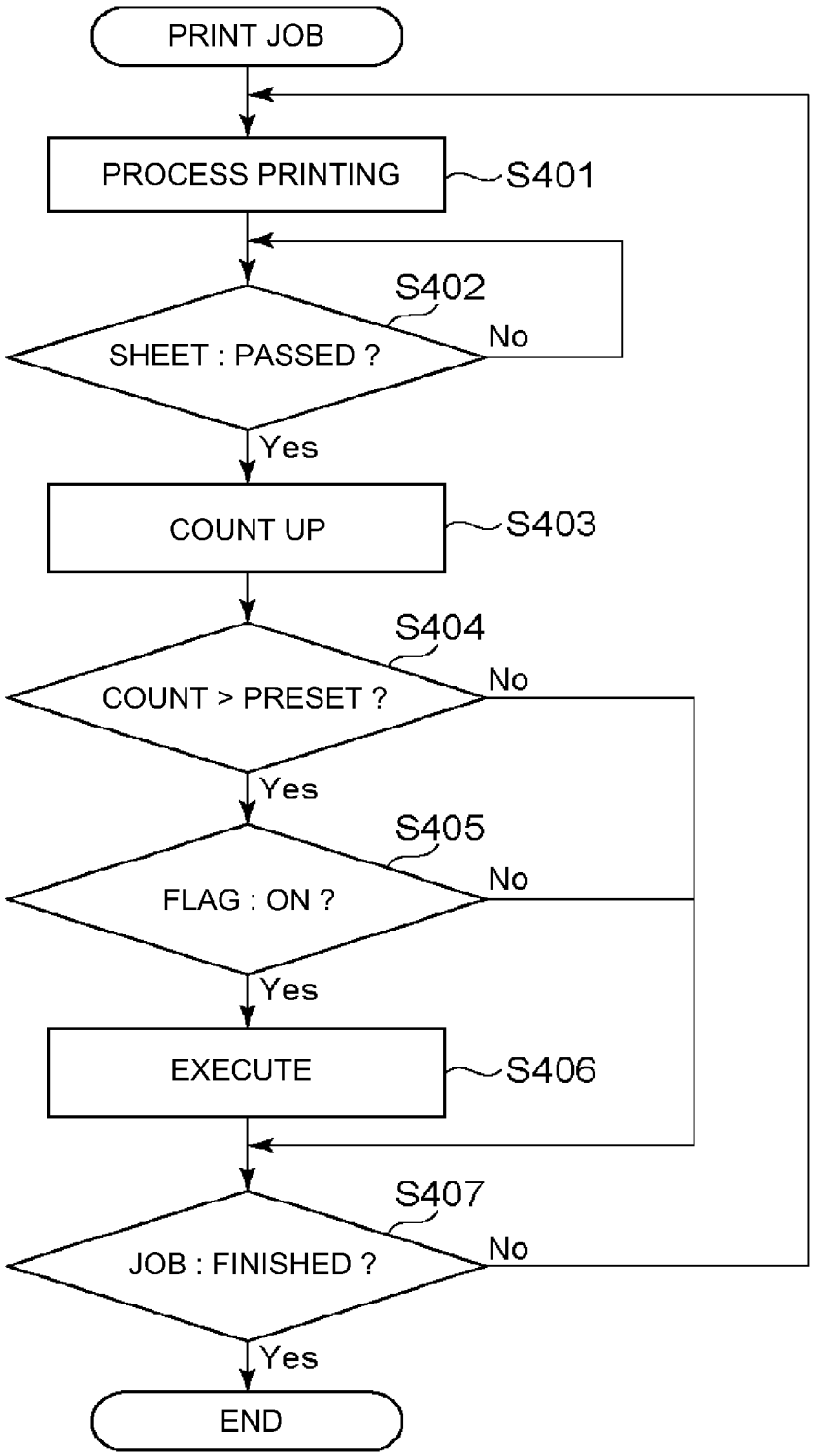
FIG. 12 is a flow chart of a sequence of whether to execute a fixing element refreshing operation.

FIG. 12 is a flow chart of a sequence of whether to execute a fixing element refreshing operation. More specifically, it is a flow chart at the time when the printing job is carried out by the image forming apparatus 100.

In the stand-by mode in which the image forming apparatus 100 is operable for the printing, the CPU301 carries out the processing for the operating portion 180, the printing job (printing instruction) received from an external PC or the like through the external I/F portion 304. At this time, the CPU301 receives, as the contents of the printing job of the operator, the original to be printed, the number of the prints, and the kind of the recording material 102 of the prints.

The CPU301 carries out the image forming process (printing process) on the recording material 102 while controlling the stations 120-123, the first fixing device 150, the second fixing device 170, the feeding portion 308 and so on of the image forming apparatus 100 (S401).

When the CPU301 detects the feeding of the recording material to the first fixing device 150 (S402, Yes), it increments the count on the RAM 302 (S403). The CPU301 increments the count corresponding to the width size of the recording material 102 fed to the first fixing device 150 of the counts on the RAM 302. The CPU301 has already acquired the information indicative of the width size of the recording material 102 as a content of the printing job. The CPU301 detects the feeding of the recording material 102 to the first fixing device 150 on the basis of the signal from the upstream side sensor 155 with respect to the feeding direction of the recording material 102 in first fixing device 150.

On the other hand, in step S402, if the feeding of the recording material 102 to the first fixing device 150 is not detected, the CPU301 does not increment the count. For example, this is the case that a predetermined time after output of the signal indicating the passage of the recording material 102 by the sensor 155, the next signal indicating the passage of the recording material 102 is not detected, despite the printing job having not yet been finished. The time period is counted by the timer 307. In such a case, the CPU301 may discriminate occurrence of sheet jamming and may effects jam clearance sequence operations.

In step S404, if the feeding numbers for all of the width sizes on the RAM 302 are not more than the predetermined value, the CPU301 proceed to step S407. On the other hand, in S404, if any one of the feeding numbers for all of the width sizes on the RAM 302 exceeds the predetermined value, the CPU301 proceeds to step S405.

In step S405, if a flag for the fixing element refreshing operation on the RAM 302 is ON, the CPU301 proceeds to step S406, in which the above-described fixing element refreshing operation is carried out. After the completion of the fixing element refreshing operation, the CPU301 resets the counts for the respective width sizes to zero on the RAM 302.

On the other hand, if the flag for the fixing element refreshing operation on the RAM 302 is not ON (that is, if it is OFF) in the step S405, the CPU301 proceeds to step S407. That is, the CPU301 does not execute the fixing element refreshing operation irrespective of the count indicated by the RAM 302.

The flag for the fixing element refreshing operation on the RAM 302 is already being set on the basis of the setting information read out of the memory 154 by the CPU301 upon the actuation of the main switch 101 or the closure of the front door 140. That is, the CPU301 as the controller controls whether to permit the fixing element refreshing operation on the basis of the information stored in the memory 154.

In the step S407, if the printing job is not finished, the CPU301 proceeds to the step S401 and repeats the operations of the steps S401-S407, until the printing job is finished.

As described hereinbefore, the exchange of the first fixing device 150 by the operator necessitates the opening and closing of the front door 140 of the image forming apparatus 100. When the front door 140 of the image forming apparatus 100 is opened by the operator, the first fixing device 150 may be exchanged. In addition, when the main switch 101 is off, the first fixing device 150 may have been exchanged. Therefore, upon the actuation of the main switch 101 of the image forming apparatus 100 and/or the closure of the front door 140, the CPU reads the information out of the memory 154 of the first fixing device 150 to acquire the information of the feeding number in the memory 154.

By this, the CPU301 can control whether to permit the fixing element refreshing operation for the first fixing device 150 on the basis of the set information stored in the memory 154 of the first fixing device 150, that is, on the basis of the fixing element refreshing operation setting provided for each fixing device. Therefore, it is unnecessary for the operator to set the information as to whether to permit the fixing element refreshing operation each time of the replacement of the first fixing device 150, and therefore, the usability is improved.

In the operation flow of FIG. 12, the timing of the discrimination whether the flag for the fixing element refreshing operation is ON or not is not limited to that described above.

For example, the discrimination of step S405 is effected prior to the step S403, and if the flag for the fixing element refreshing operation is OFF (the fixing element refreshing operation is not permitted), the counting of the feeding number may not be carried out. That is, when the setting is to prohibit the fixing element refreshing operation, the counting of the feeding number is not effected, and the fixing element refreshing operation is not the effected.

Alternatively, once the discrimination of the flag for the fixing element refreshing operation after the start of the printing job process, the discrimination of the flag may not be carried out until the printing job is finished. Even in such a case, however, when the front door 140 is opened in the process of the printing job (jam clearance, for example), it is desirable that the discrimination of the flag for the fixing element refreshing operation is carried out after the closure of the 140 through the flow of FIG. 11. This is because, that is a likelihood that the first fixing device 150 is exchanged during the open state of the front door 140.

Furthermore, the discriminations of the steps S404 and S405 may be interchanged.

The execution timing of the fixing element refreshing operation is not limited to that described above. In FIG. 12, the fixing element refreshing operation is carried out while interrupting the printing job, in the case that the flag for the fixing element refreshing operation is ON and that any one of the counts of the feeding numbers for the respective width sizes on the RAM 302 exceeds the predetermined value. However, the fixing element refreshing operation may be carried out after the finishing of the current printing job, in the case that the flag for the fixing element refreshing operation is ON and that any one of the counts of the feeding numbers for the respective width sizes on the RAM 302 exceeds the predetermined value. The glossiness unevenness attributable to the difference in the surface roughness between (I) passing portion, (II) non-passing portion and (III) boundary area is remarkable when the fixing process is carried out on large width size recording material 102. Therefore, as long as the printing process is carried out for the same width size recording materials, the glossiness unevenness is less remarkable than when the fixing process is effected on the large width size recording materials 102. By executing the fixing element refreshing operation after the current printing job is finished, the waiting time before the finishing of the current printing job can be reduced.

In this embodiment, the set information indicative of permission of the fixing element refreshing operation as the default setting is stored in the memory 154, but this is not inevitable, and the default setting may be to prohibit the fixing element refreshing operation. Alternatively, in the operation flows of FIG. 10 and/or FIG. 11, when the fixing element refreshing operation setting cannot be acquired from the memory 154, the operation may proceed to the setting sequence of FIG. 9.

In the description of the foregoing embodiment, the description has been made with respect to the first fixing device 150, but the same applies to the second fixing device 170.

[Embodiment 2]

In Embodiment 1, the information (set information) indicative of whether to permit the execution of the fixing element refreshing operation is stored in the memory 154 of the first fixing device 150. The CPU301 controls whether to permit the execution of the fixing element refreshing operation on the basis of the information.

In Embodiment 2, the set information is stored in the main assembly memory 312 in correlation with the first fixing device 150. That is, the main assembly memory 312 functions as the storing portion. FIG. 13 illustrates an example of information stored in the main assembly memory.

Similarly to Embodiment 1, the information "execution" or "non-execution" is stored. The "execution" indicates that the execution of the fixing element refreshing operation is permitted, and the "non-execution" indicates that the execution of the fixing element refreshing operation is prohibited.

The memory 154 stores ID (identifying information) for discrimination from that replacement fixing device or fixing devices usable as the first fixing device 150 in the first mounting portion 141.

The same applies to the second fixing device 170.

In the description of this embodiment, the same reference numerals as in Embodiment 1 are assigned to the elements having the corresponding functions in this embodiment, and the detailed description thereof is omitted for simplicity.

In the following, the description will be made with respect to the first fixing device 150. The same applies to the second fixing device 170.

(12. Control Flow)

Referring to flow charts of FIGS. 14-16 and FIG. 12 of Embodiment 1, the description will be made particularly on the difference from Embodiment 1. The operations of the flow charts are carried out by the CPU301 functioning as the executing portion (recording portion) controlling the related mechanisms of the image forming apparatus 100 in accordance with the control program stored in the ROM 303. The description will be made as to the first fixing device 150, but the same applies to the second fixing device 170.

(12. 1. Sequence Upon Actuation of the Main Switch and Upon Closing the Front Door)

Figure 14:
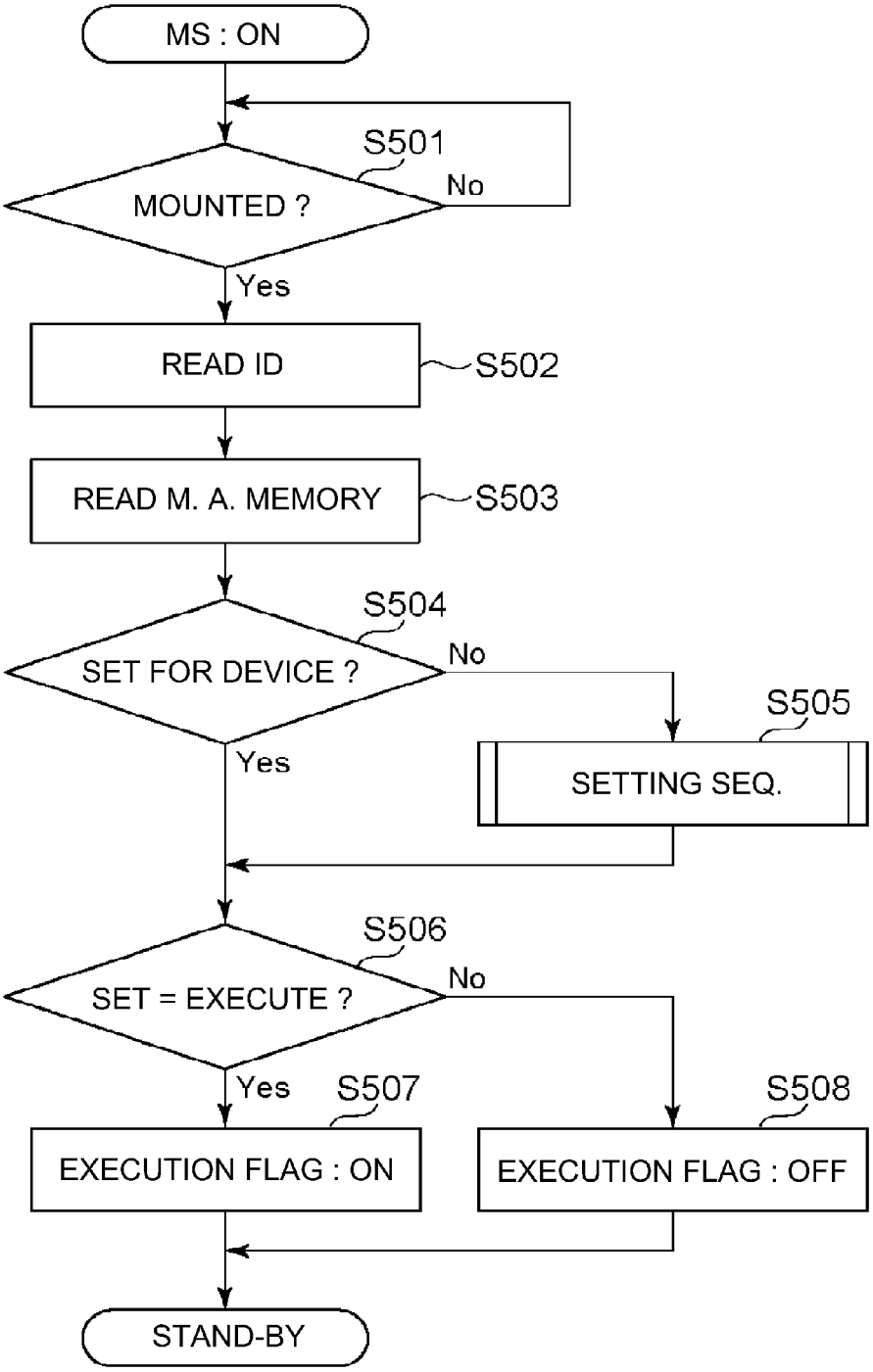
FIG. 14 is a flow chart showing the operations from the actuation of a main switch to a stand-by mode.

FIG. 14 is a flow chart showing the operations from the actuation of a main switch to a stand-by mode.

A step S501 is the same as the step S201 of Figure, and therefore, the description thereof is omitted.

The CPU301 reads in the ID (identifying information) of the first fixing device 150 out of the memory 154 of the first fixing device 150 mounted in the main assembly 100 (S502).

The CPU301 reads the fixing element refreshing operation setting (set information) corresponding to the ID of the first fixing device 150 acquired in the step S502 out of the main assembly memory 312 (S503) More particularly, the CPU301 searches for the information indicative of the ID of the first fixing device 150 acquired in the S502, in the main assembly memory 312. If the main assembly memory 312 stores such information, the CPU301 acquires the set information correlated with the ID of the first fixing device 150.

When the main assembly memory 312 stores such information (S504, Yes), the CPU301 proceeds to a step S506.

On the other hand, if the main assembly memory 312 does not store such information (S504, No), the CPU301 proceeds to a step S505. The CPU301 executes the setting sequence of FIG. 16 to permit setting of whether to permit the fixing element refreshing operation for the first fixing device 150 mounted in the image forming apparatus 100 (S505).

If the fixing element refreshing operation setting acquired in the step S503 indicates "execution", or the information set in the step S505 indicates "execution" (S506, Yes), the CPU301 proceeds to a step S504.

On the other hand, if the fixing element refreshing operation setting acquired in the step S503 indicates "non-execution", or the information set in the step S505 indicates "non-execution" (S506, No), the CPU301 proceeds to a step S508.

A step S507 is the same as the step S301 of FIG. 10, and therefore, the description thereof is omitted.

A step S508 is the same as the step S205 of FIG. 10, and therefore, the description thereof is omitted.

Then, the CPU301 proceeds to the stand-by mode.

Figure 15:
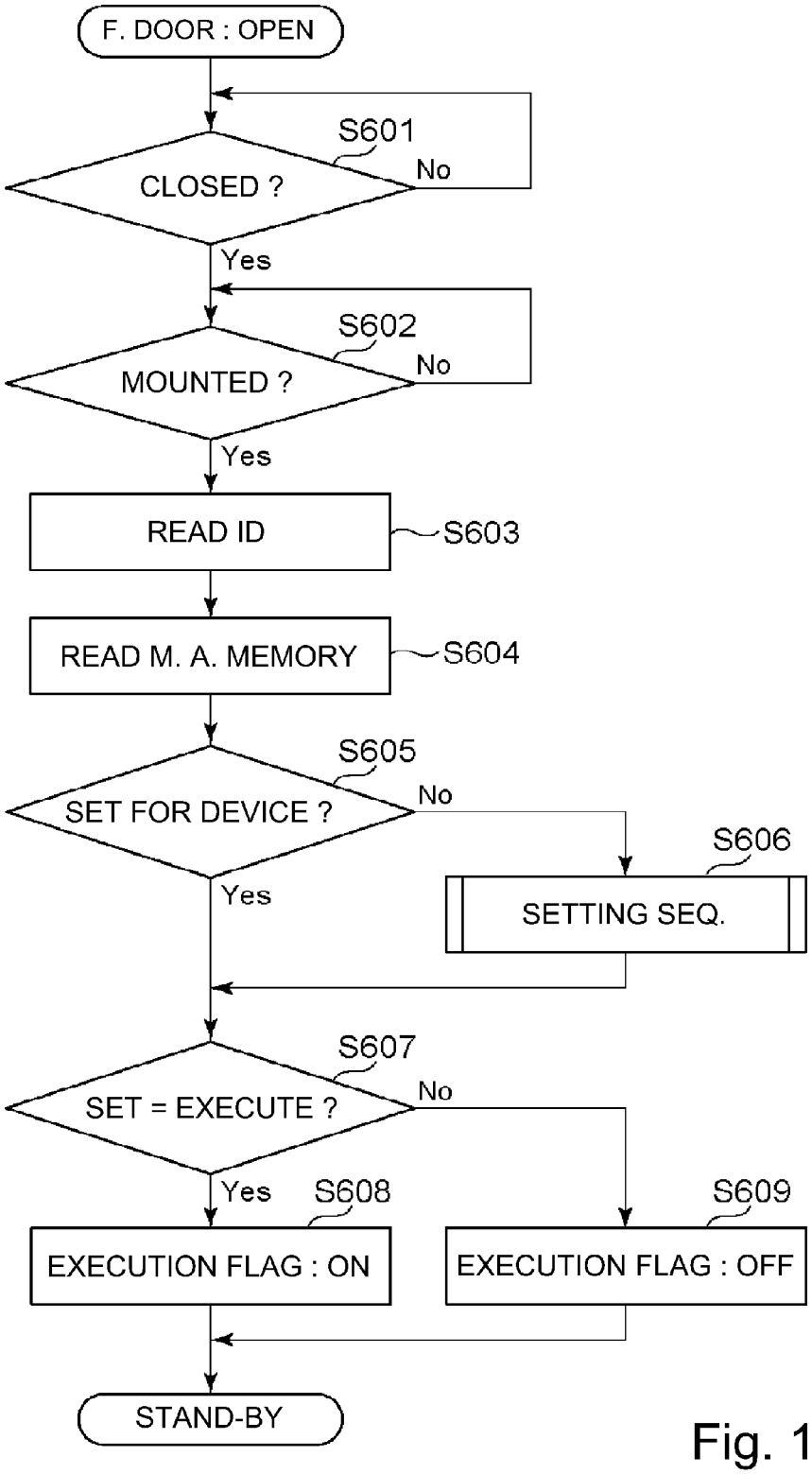
FIG. 15 is a flow chart showing the operations from the state in which a front door is open to the stand-by mode.

FIG. 15 is a flow chart showing the operations from the state in which a front door is open to the stand-by mode.

The steps S601 and S602 are the same as the steps S301 and S302 of FIG. 11, respectively, and therefore, the description is omitted.

The steps S603 and S604 are the same as the steps S502 and S503 of FIG. 14, and therefore, the description thereof is omitted.

A step S605 is the same as the step S504 of FIG. 14, and therefore, the description thereof is omitted.

A step S606 is the same as the step S505 of FIG. 14, and therefore, the description thereof is omitted.

A step S607 is the same as the step S506 of FIG. 14, and therefore, the description thereof is omitted.

The steps S608 and S609 are the same as the steps S507 and S508 of FIG. 14, and therefore, the description thereof is omitted.

Then, the CPU301 proceeds to the stand-by mode.

In the operation flow of FIGS. 14 and 15, once the fixing element refreshing operation setting is recorded, the CPU301 discriminates "Yes" in the subsequent steps S504 and S605. Therefore, the CPU301 can automatically control whether to permit the execution of the fixing element refreshing operation on the basis of the set information for the ID of the first fixing device 150 acquired from the main assembly memory 312, without the setting operation for the fixing element refreshing operation by the operator.

(12. 2. Setting Sequence)

Figure 16:
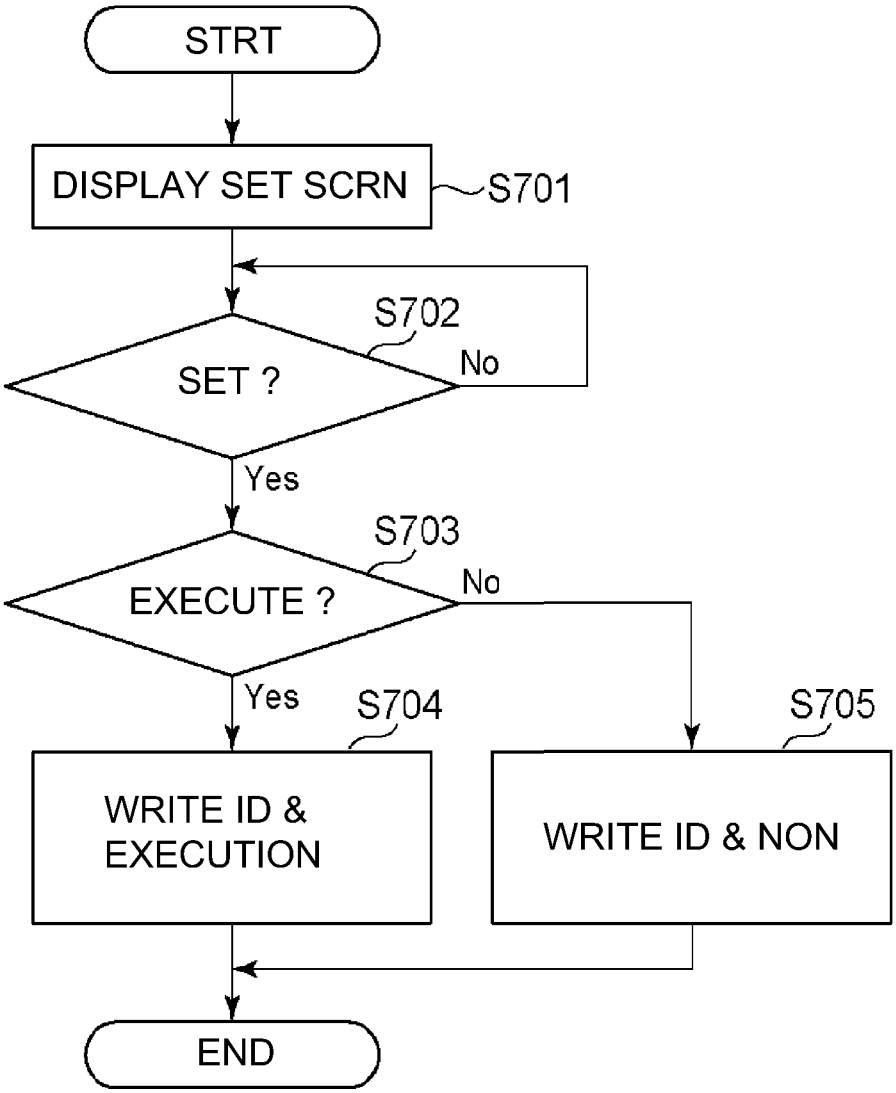
FIG. 16 is a flow chart of a setting sequence.

FIG. 16 is a flow chart of a setting sequence. The setting sequence is executed in the step S505 of FIG. 14, the step S606 of FIG. 15, or when the selector of the operating portion 180 for displaying the setting screen.

The CPU301 displays the setting screen for setting whether to permit the fixing element refreshing operation on the display screen of the operating portion 180 (S701). More particularly, as shown in FIG. 7, for example, the screen prompting the setting is shown.

A step S702 is the same as the step S102 of FIG. 9, and therefore, the description thereof is omitted.

When the permission of the fixing element refreshing operation is set by the operator (S703, Yes), the CPU301 proceeds to a step S704.

In S704, the CPU301 writes the "execution" in the main assembly memory 312 as the fixing element refreshing operation setting information. Here, the CPU301 records the information in correlation with the ID of the first fixing device 150 mounted in the image forming apparatus 100. That is, the CPU301 records in the main assembly memory 312 the information indicative of the permission of the fixing element refreshing operation in correlation with the ID of the first fixing device 150, as the set information.

On the other hand, when the prohibition of the fixing element refreshing operation is set by the operator, the CPU301 proceeds to step S705 (S703, No).

In S705, the CPU301 writes the "non-execution" in the main assembly memory 312 as the fixing element refreshing operation setting information. Here, the CPU301 records the information in correlation with the ID of the first fixing device 150 mounted in the image forming apparatus 100. That is, the CPU301 records in the main assembly memory 312 the information indicative of the prohibition of the fixing element refreshing operation in correlation with the ID of the first fixing device 150.

In S704 and S705, the ID of the first fixing device 150 is already acquired in the sequence (FIGS. 14, 15) carried out in response to the actuation of the main switch 101 or the closure of the front door 140. When the ID of the first fixing device 150 is already recorded in the main assembly memory 312, the information for the fixing element refreshing operation setting is recorded in correlation with the ID. When the ID of the first fixing device 150 is not stored in the main assembly memory 312, the information for the fixing element refreshing operation setting is recorded in correlation with the ID of the first fixing device 150.

(12. 3. Sequence as to Whether to Execute Fixing Element Refreshing Operation)

The description will be made utilizing FIG. 12.

The flag on the RAM 302 used in the step S405 of FIG. 12 has been set on the basis of the set information for the first fixing device 150 by the CPU301 upon the actuation of the main switch 101 or the closure of the front door 140 (FIGS. 14, 15). Thus, the CPU301 as the controller controls without to permit the fixing element refreshing operation in accordance with the set information stored in the main assembly memory 312 in correlation with the ID of the first fixing device 150.

This embodiment is the same as Embodiment 1 on the other respects, and the description is omitted.

In this embodiment, the flag for the fixing element refreshing operation is actuated on the RAM 302 in accordance with the set information stored in the main assembly memory 312 in correlation with the ID of the first fixing device 150. However, the set information per se of the main assembly memory 312 may correspond to the ON•OFF of the flag.

As described hereinbefore, the exchange of the first fixing device 150 by the operator necessitates the opening and closing of the front door 140 of the image forming apparatus 100. When the front door 140 of the image forming apparatus 100 is opened by the operator, the first fixing device 150 may be exchanged. In addition, when the main switch 101 is off, the first fixing device 150 may have been exchanged. Therefore, upon the actuation of the main switch 101 of the image forming apparatus 100 and/or the closure of the front door 140, the CPU reads the information out of the memory 154 of the first fixing device 150 to acquire the identifying information. Then, the CPU acquires the set information for the ID of the first fixing device 150 mounted in the image forming apparatus 100, from the main assembly memory 312.

By this, the CPU301 can control whether to permit the fixing element refreshing operation for the first fixing device 150 in accordance with the fixing element refreshing operation setting set for each fixing device. Therefore, it is unnecessary for the operator to set the information as to whether to permit the fixing element refreshing operation each time of the replacement of the first fixing device 150, and therefore, the usability is improved.

(13. Identifying Information)

In the foregoing, the discrimination portion having the identifying information has been the memory 154, 174, but the structure of the discrimination portion is not limited to these elements.

For example, resistors as the discrimination portions may be provided on the first fixing device 150, the second fixing device 170 and the replacement fixing device prepared outside the image forming apparatus 100.

The resistors provided on them have resistance values different from each other.

In the state that the first fixing device 150 is mounted in the image forming apparatus 100, a current flowing through the resistor upon the application of a predetermined voltage across the resistor of the first fixing device 150 is detected.

More particularly, the image forming apparatus 100 is provided with the ammeter as a means (discrimination member 311 of FIG. 2) for identifying the first fixing device 150, the ammeter being effective to detect the current flowing between the resistor 1154 and the voltage application portion at which the regular voltage is applied to the resistor 1154. The discrimination member 311 contacts the resistor as the discrimination portion of the first fixing device 150 in the state that the first fixing device 150 is mounted in image forming apparatus 100. The CPU301 monitors the output of the ammeter to acquire the identifying information of the first fixing device 150.

When the regular voltage is applied, the current corresponds to the resistance value one by one because of the Ohm's law. The CPU301 acquires an output of the ammeter predetermined resistance of the resistor 1154. The first fixing device 150 and the replacement fixing device have the resistors having different resistance values, and therefore, the CPU301 is capable of discriminating the fixing device depending on the difference of the output of the ammeter. Thus, the resistance value is the identifying information.

In such a case, the CPU301 acquires the resistance value of the resistor of the first fixing device 150 in this manner, in S502 of FIG. 14 and S603 of FIG. 15.

The method of writing (recording) the ID of the fixing device into the main assembly memory 312 is not limited to the use of the resistance value as the identifying information. For example, the main assembly memory 312*s* stores a Table of the correspondence between the resistance values of the resistors and the names of the fixing devices (fixing device 1, for example) in correlation with the resistance values, respectively.

The CPU301 may use the output of the ammeter as the identifying information without acquiring the resistance value of the resistor. That is, the CPU301 may record the output of the ammeter in the main assembly memory 312 as in the ID of the fixing device.

The same applies to the means for discriminating the second fixing device 170.

The CPU301 is connected with the voltage application portion and the ammeter as means for discriminating the first fixing device 150 and is connected with the voltage application portion and the ammeter as the means for discriminating the second fixing device 170. When the first fixing device 150 is mounted to the image forming apparatus 100, the voltage application portion and the ammeter as the means for discriminating the first fixing device 150 become capable of electrically connecting with the resistor of the first fixing device 150. When the second fixing device 170 is mounted to the image forming apparatus 100, the voltage application portion and the ammeter as the means for discriminating the second fixing device 170 become capable of electrically connecting with the resistor of the second fixing device 170.

As for another example of the method for discriminating the fixing device, a DIP switch is usable as the discrimination portion provided on the fixing device (first fixing device 150, second fixing device 170 and replacement fixing device).

More particularly, the switches which are different depending on the fixing devices are in ON state beforehand (the on-off state and position of the switches are different depending on the fixing devices). The CPU301 is connected with the DIP switch of the fixing device mounted in the image forming apparatus 100, and the switch in ON state produces a signal to the CPU301 in response to an input signal from the CPU301. The CPU301 detects the signal from the ON state switch (acquires the fixing device ID) to discriminate the fixing device.

For example, the CPU301 supplies signals to the first and second switches. As a result, the CPU301 discriminates that it is the fixing device 1, and when the CPU301 detects the output signal from the second switch, it is the fixing device 2, and when the CPU301 detects the signals from both of the first and second switches, it is the fixing device 3.

[Embodiment 3]

In Embodiment 2, the CPU301 stores the information (set information) indicative of whether to permit the execution of the fixing element refreshing operation in the main assembly memory 312.

In this embodiment, the CPU301 stores and the set information in a server (storing device) 400 (image forming system).

In this embodiment, the description will be made as to the difference from the Embodiment 2.

(14. Image Forming System)

Figure 17:
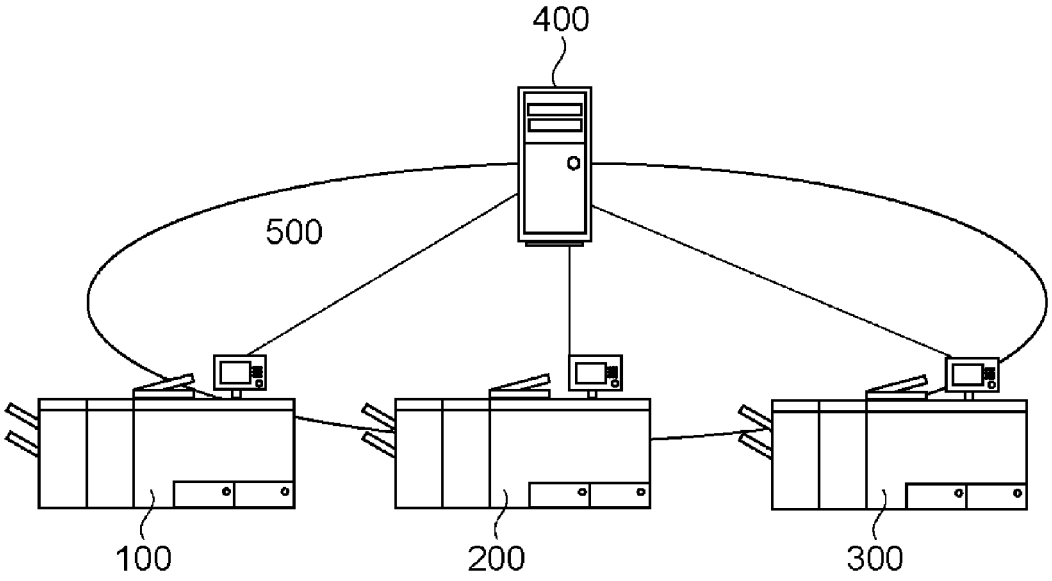
FIG. 17 illustrates an example of a structure of an image forming system.

FIG. 17 illustrates an example of a structure of an image forming system. An image forming apparatus 200 and an image forming apparatus 300 are image forming apparatuses having the same structure as the image forming apparatus 100. The set information for the first fixing device 150, the second fixing device 170 and a fixing device replaceable therewith, which are commonly usable by the image forming apparatuses (100, 200, 300) is supplied to the server 400 from the image forming apparatuses through a network 500. The server 400 centrally manages the set information for the respective fixing devices.

Figure 18:
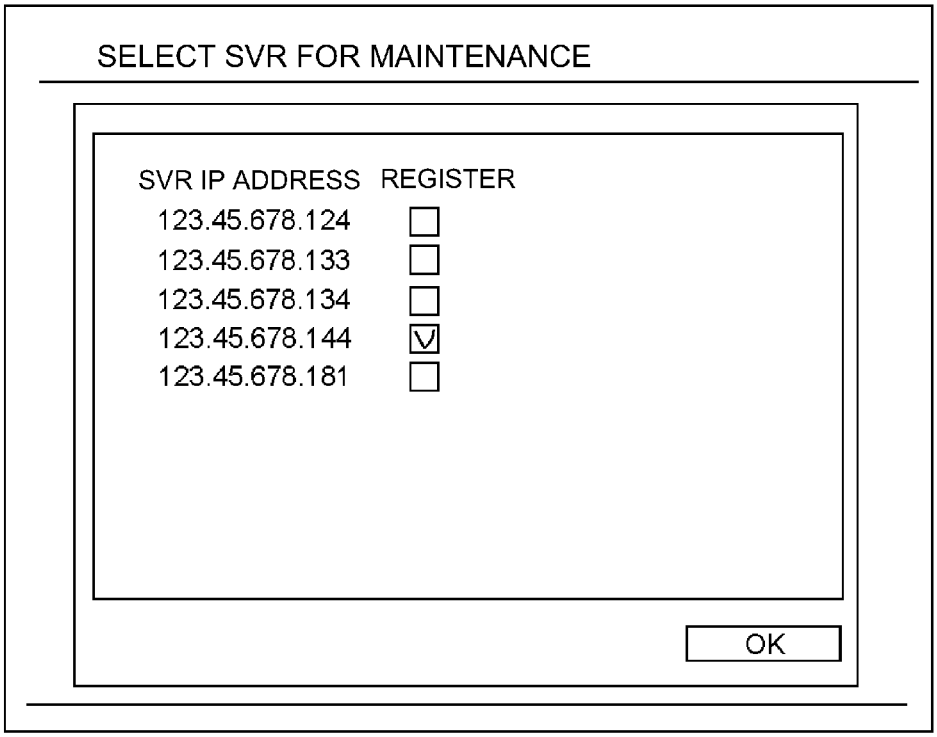
FIG. 18 shows an example of a registration screen of a server.

The setting in the server is carried out on the operating portion of the image forming apparatus (the operating portion 180 of the image forming apparatus 100, for example). FIG. 18 shows an example of a registration screen of a server. The server IP address list in the screen contains a list connected by the same network including the image forming system. The operator registers the server from which the set information is to be acquired, in the list. For example, when the server 400 is registered from the image forming apparatus 100 through the operating portion 180, the IP address of the registered server 400 is stored in the main assembly memory 312, and is used when the set information is to be acquired.

(15. Structure of Server)

Figure 19:
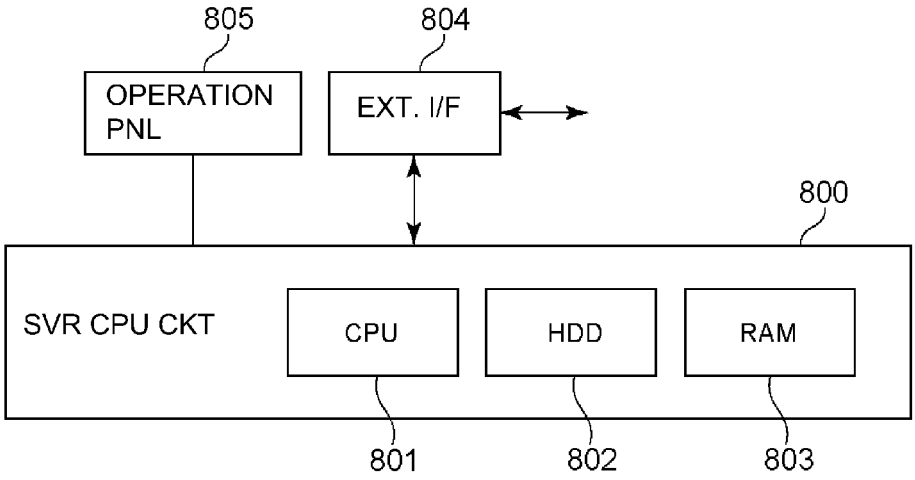
FIG. 19 is a block diagram of an example of a structure of a control system for the server.

FIG. 19 is a block diagram of an example of a structure of a control system for the server. As shown in FIG. 19, a server CPU circuit portion 800 of the server 400 comprises CPU801, HDD802, RAM 803. The operations of the flow chart of the server which will be described hereinafter are executed by the CPU801 on the basis of the control program stored in the HDD802. The CPU301 uses the RAM 803 as a work area for executing the processing of the control program. The RAM 803 is a rewritable non-volatile memory and stores and manages the set information for the respective fixing devices in the image forming system.

The server CPU circuit portion 800 is connected with an outside I/F portion 804 of the server 400. An external I/F portion 804 is a communication circuit for communication with an external device connected through network (LAN and/or WAN). The external device may be image forming apparatuses 100, 200 and 300 or the like. For the transaction of the data between the image forming apparatus 100, the server CPU circuit portion 800 communicates with the outside I/F portion 304 of the image forming apparatus 100 through the outside I/F portion 804. By this, the server 400 is capable of communicating with the image forming apparatus 100 for the transaction of the data such as the identifying information and/or the set information of the first fixing device 150 and/or the second fixing device 170.

The server 400 is provided with an operating portion 805. The operating portion 805 is provided with a display screen and selection keys. The server CPU circuit portion 800 controls the content of the display to the operating portion 805 and acquires the information inputted to the operating portion 805.

(16. Control Flow 3)

Referring to FIGS. 20-24, the control flow of this embodiment will be described.

The operation flow of the image forming apparatus side in the image forming system of this embodiment will be described, taking the image forming apparatus 100 as an example. The operation shown in the flow chart for the image forming apparatus 100 is carried out by the CPU301 functioning as the executing portion (recording portion) to control the operations of the various mechanisms of the image forming apparatus 100 on the basis of the control program stored in the ROM 303. The description will be made as to the first fixing device 150, but the same applies to the second fixing device 170.

The operation shown in the flowchart for the server 400 is carried out by the CPU801 controlling the operations of various mechanisms of the server 400 on the basis of the control program stored in the HDD802.

(16. 1. Sequence Upon Actuation of the Main Switch and Upon Closing the Front Door)

Figure 20:
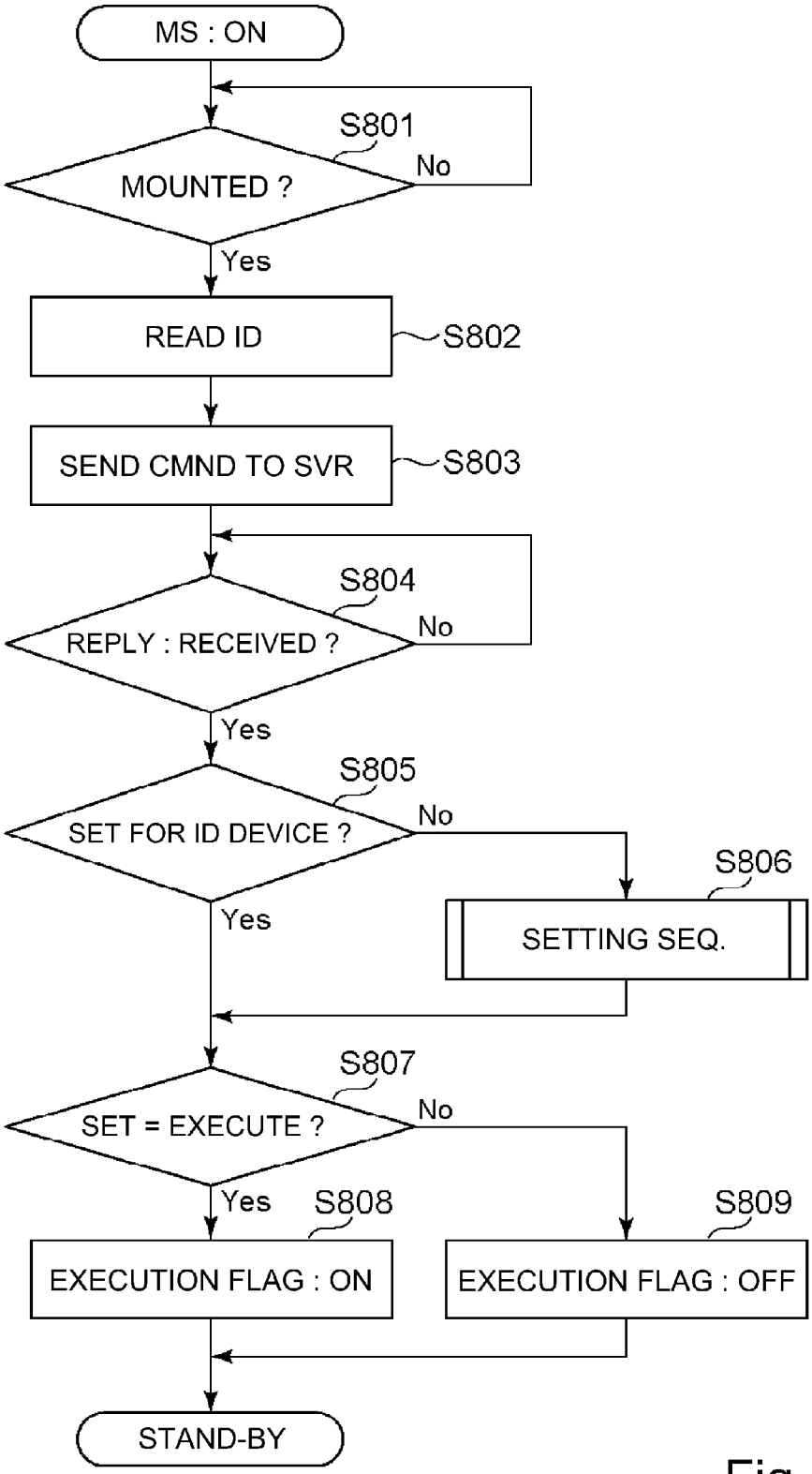
FIG. 20 is a flow chart showing the operations from the actuation of a main switch to a stand-by mode.

FIG. 20 is a flow chart showing the operations from the actuation of a main switch to a stand-by mode. FIG. 20 is an operation flow for the image forming apparatus 100.

Steps S801 and S802 are the same as the steps S501 and S502 of FIG. 14, and therefore, the description thereof is omitted.

In step S803, the CPU301 sends an inquiry command to the server 400 drum one the fixing element refreshing operation setting (set information) corresponding to the ID of the first fixing device 150 read out in the step S802. The server 400 to which the command is sent is the preset server, and the IP address of the preset server 400 is stored in the main assembly memory 312.

In step S804, the CPU301 waits for the response from the server 400 to the inquiry sent in the step S803. That is, the CPU301 acquires the information corresponding to the ID of the first fixing device 150 from the server 400.

If the response received from the server 400 indicates that the set information for the ID of the first fixing device 150 is stored (S805, Yes), the CPU301 proceeds to step S807.

If not (S805, No), the CPU301 proceeds to a step S806. 23 the CPU301 executes the setting sequence of Figure to permit setting of whether to permit the fixing element refreshing operation for the first fixing device 150 mounted in the image forming apparatus 100 (S806).

If the information (set information) for the fixing element refreshing operation setting acquired from the server indicates "execution", or the set information set in the step S806 indicates "execution" (S807, Yes), the CPU301 proceeds to a step S808.

On the other hand, if the information (set information) for the fixing element refreshing operation setting acquired from the server indicates "non-execution", or the set information set in the step S806 indicates "non-execution" (S807, No), the CPU301 proceeds to a step S809.

A step S808 is the same as the step S507 of FIG. 14, and therefore, the description thereof is omitted.

A step S809 is the same as the step S508 of FIG. 14, and therefore, the description thereof is omitted.

Then, the CPU301 proceeds to the stand-by mode.

Figure 21:
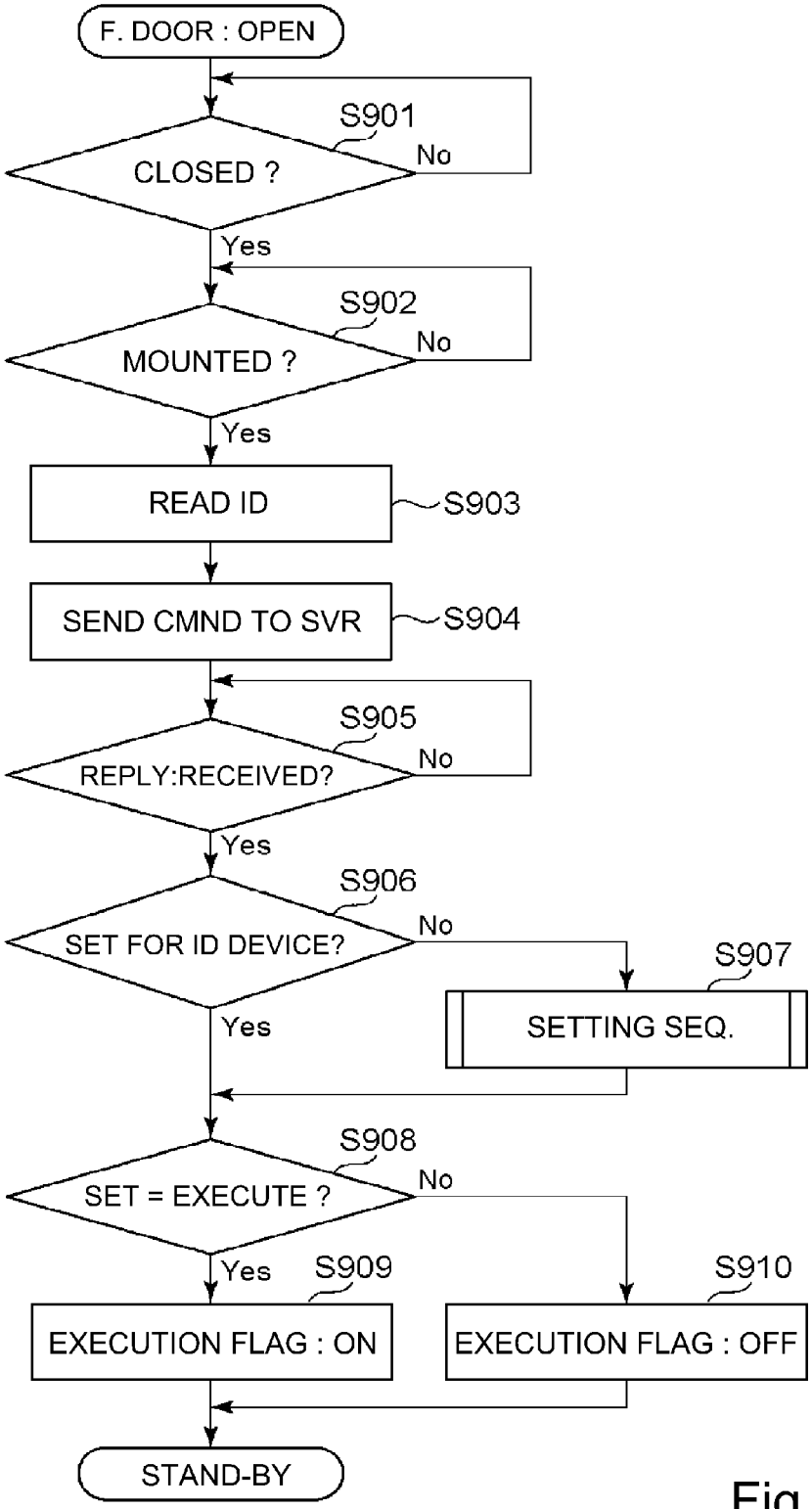
FIG. 21 is a flow chart showing the operations from the state in which a front door is open to the stand-by mode.

FIG. 21 is a flow chart showing the operations from the state in which a front door is open to the stand-by mode in the image forming apparatus 100 side. steps S901-S903 are similar to the steps S601-S603 of FIG. 15, respectively, and therefore, the description thereof is omitted.

Steps S904-S910 are the same as the steps S803-S809 of FIG. 20, respectively, and therefore, the description thereof is omitted.

Then, the CPU301 proceeds to the stand-by mode.

Figure 22:
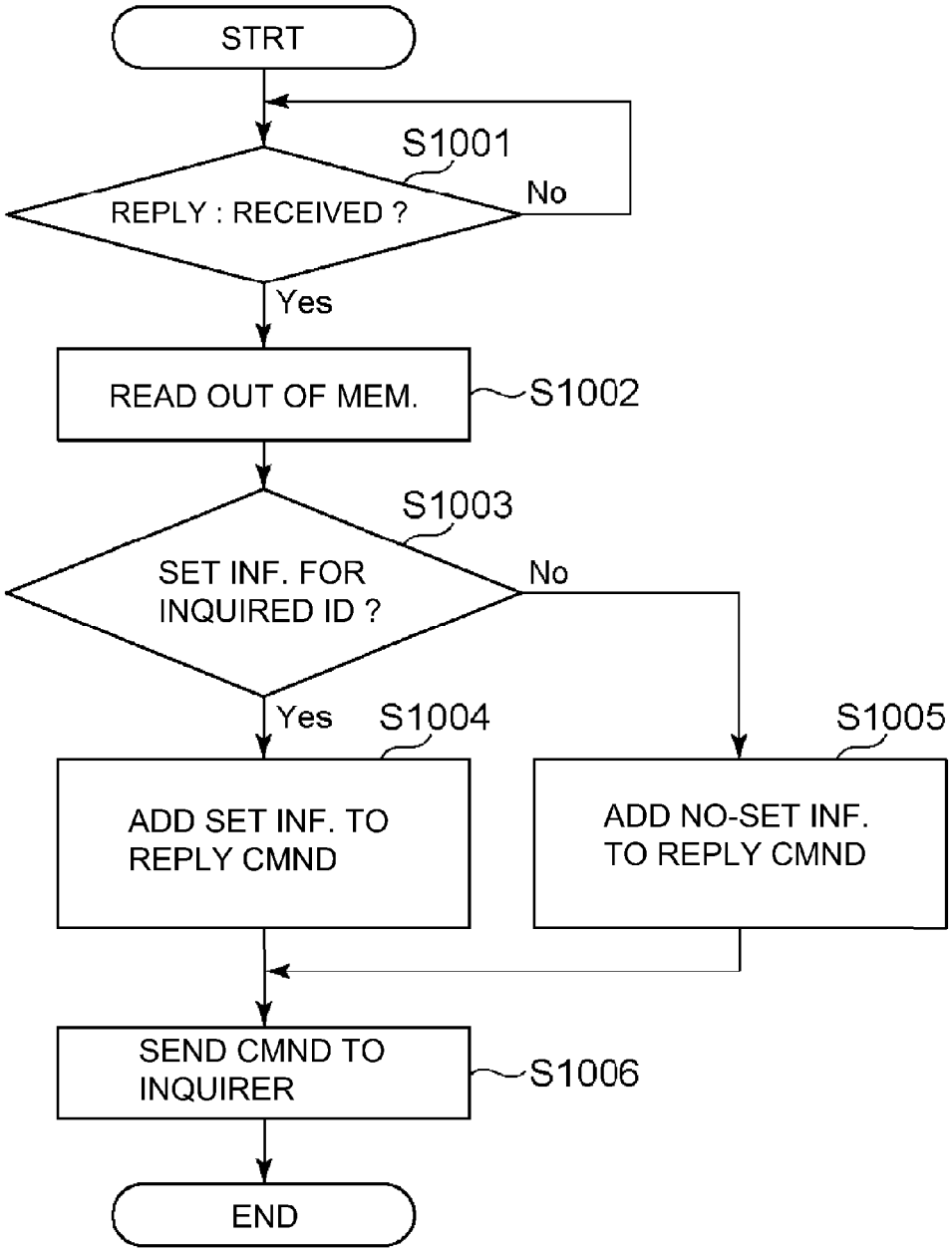
FIG. 22 is a flow chart in the server side relating to reading of the fixing element refreshing operation setting.

The operation flow of the server 400 side will be described. FIG. 22 is a flow chart in the server side relating to reading of the fixing element refreshing operation setting.

In S1001, the CPU801 monitors whether or not the inquiry command about the fixing element refreshing operation setting is received from any image forming apparatus within the network 500 including the image forming apparatus 100. When such a command is received, the CPU801 proceeds to a step S1002. Here, suppose that an inquiry command about the fixing element refreshing operation setting for the first fixing device 150 is received from the image forming apparatus 100.

The CPU801 discriminates whether or not the information (set information) of the fixing element refreshing operation setting corresponding to the ID of the first fixing device 150 is registered in the RAM 803. The inquiry command is with the information of the ID of the first fixing device 150 read out by the CPU301 of the image forming apparatus 100.

If the set information is registered in the RAM 803, the CPU801 proceeds to a step S1004. In S1004, the CPU801 adds the set information to the reply command.

And the hand, if the set information is not registered in the RAM 803, the CPU801 proceeds to step S1005. In S1005, the CPU801 adds the information indicative of non-existence of the fixing element refreshing operation setting in the reply command.

The CPU801 sends the reply command to the image forming apparatus 100 from which the inquiry comes.

(16. 1. Setting Sequence)

Figure 23:
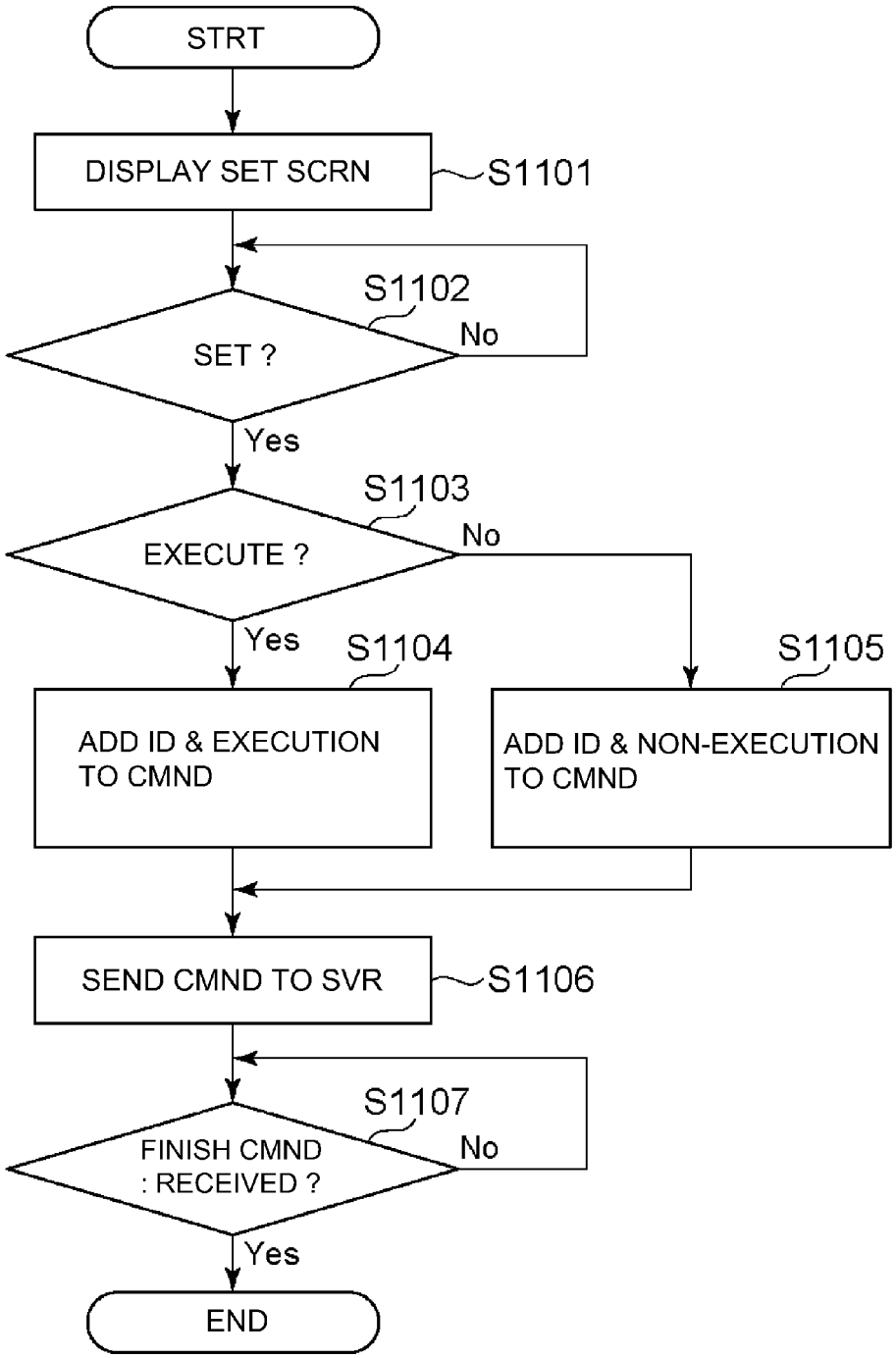
FIG. 23 is a flow chart of a setting sequence.

FIG. 23 is a flow chart of a setting sequence. FIG. 23 is an operation flow for the image forming apparatus 100. The setting sequence is carried out in a step S806 of FIG. 20, a step S907 of FIG. 21, and when the setting of the fixing element refreshing operation is selected in the selector of the operating portion 180. In this embodiment, the fixing element refreshing operation setting is effected through the operating portion 180 of the image forming apparatus 100 by the operator.

The steps S1101, S1102 are the same as the steps S701, S702 of FIG. 16, and therefore, the description thereof is omitted.

When the permission of the fixing element refreshing operation is set by the operator (S1103, Yes), the CPU301 proceeds to a step S1104.

In S1104, the CPU301 adds to the set command the ID (identifying information) of the first fixing device 150 mounted in the image forming apparatus 100 and the information indicative of the "execution" as the fixing element refreshing operation setting.

On the other hand, when the prohibition of the fixing element refreshing operation is set by the operator, the CPU301 proceeds to step S1105 (S1103, No).

In S1105, the CPU301 adds to the set command the ID (identifying information) of the first fixing device 150 mounted in the image forming apparatus 100 and the information indicative of the "non-execution" as the fixing element refreshing operation setting.

In a step S1106, the CPU301 sends the set command to the server 400.

When the CPU301 receives a completion command indicative of the completion of the registration of the fixing element refreshing operation setting from the server 400 (S1107), the CPU301 finishes the setting sequence.

Figure 24:
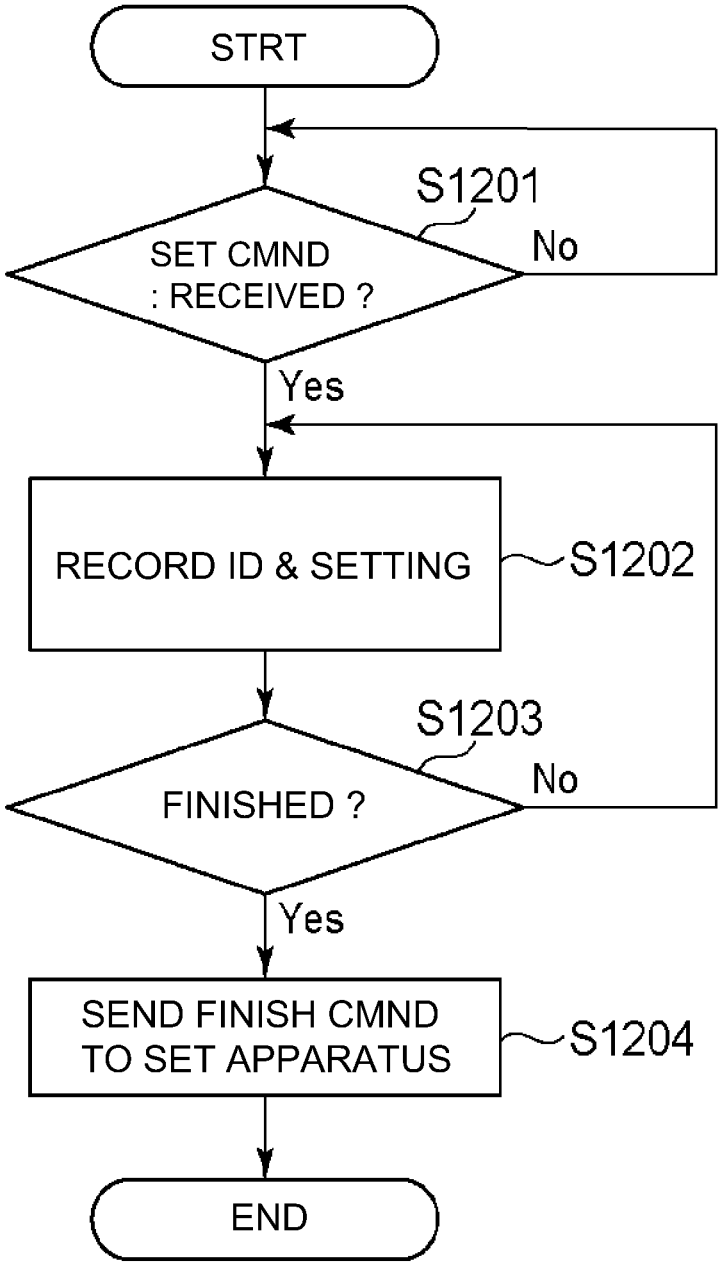
FIG. 24 is a flow chart of the server side in the setting sequence.

The operation flow of the server 400 side will be described. FIG. 24 is a flow chart of the server side in the setting sequence.

In a step S1201, the CPU801 monitors whether or not a set command for the fixing element refreshing operation setting is received from an image forming apparatus in the network 500 including the image forming apparatus 100. When the set command is received, the CPU801 proceeds to a step S1202. Here, suppose a set command is received for the first fixing device 150 from the image forming apparatus 100.

The CPU801 records the information received from the set command in the RAM 803. There, the CPU801 records the set information in correlation with the ID of the first fixing device 150. The set command includes the ID of the first fixing device 150 and the set information. When the ID of the first fixing device 150 is already recorded in the RAM 803, the information of the fixing element refreshing operation setting is recorded in correlation with the ID. If the ID of the first fixing device 150 is not recorded in the RAM 803, the ID of the first fixing device 150 and the information of the fixing element refreshing operation setting are recorded in correlation with each other.

When the recording of the information received by the set command in RAM 803 is completed (S1203), the CPU801 sends the completion of the registration a fixing element refreshing operation setting to the inquirer image forming apparatus 100 (S1204).

(16. 3. Sequence as to Whether to Execute Fixing Element Refreshing Operation)

The description will be made utilizing FIG. 12.

The flag on the RAM 302 to be discriminated in the step S405 of FIG. 12 is set on the basis of the set information correlated with the ID of the first fixing device 150 by the CPU301 upon the actuation of the main switch 101 and the closure of the front door 140. That is, the CPU301 as the controller controls whether to permit the fixing element refreshing operation on the basis of the set information stored in the server 400 in correlation with the ID of the first fixing device 150.

This embodiment is the same as Embodiment 2 on the other respects, and the description is omitted.

As described hereinbefore, the exchange of the first fixing device 150 by the operator necessitates the opening and closing of the front door 140 of the image forming apparatus 100. When the front door 140 of the image forming apparatus 100 is opened by the operator, the first fixing device 150 may be exchanged. In addition, when the main switch 101 is off, the first fixing device 150 may have been exchanged. Therefore, upon the actuation of the main switch 101 of the image forming apparatus 100 and/or the closure of the front door 140, the CPU reads the information out of the memory 154 of the first fixing device 150 to acquire the identifying information. Then, the CPU acquires the set information corresponding to the ID of the first fixing device 150 mounted in the image forming apparatus 100, from the server 400.

By this, the CPU301 can control whether to permit the fixing element refreshing operation for the first fixing device 150 in accordance with the fixing element refreshing operation setting set for each fixing device. Therefore, it is unnecessary for the operator to set the information as to whether to permit the fixing element refreshing operation each time of the replacement of the first fixing device 150, and therefore, the usability is improved.

Figure 25:
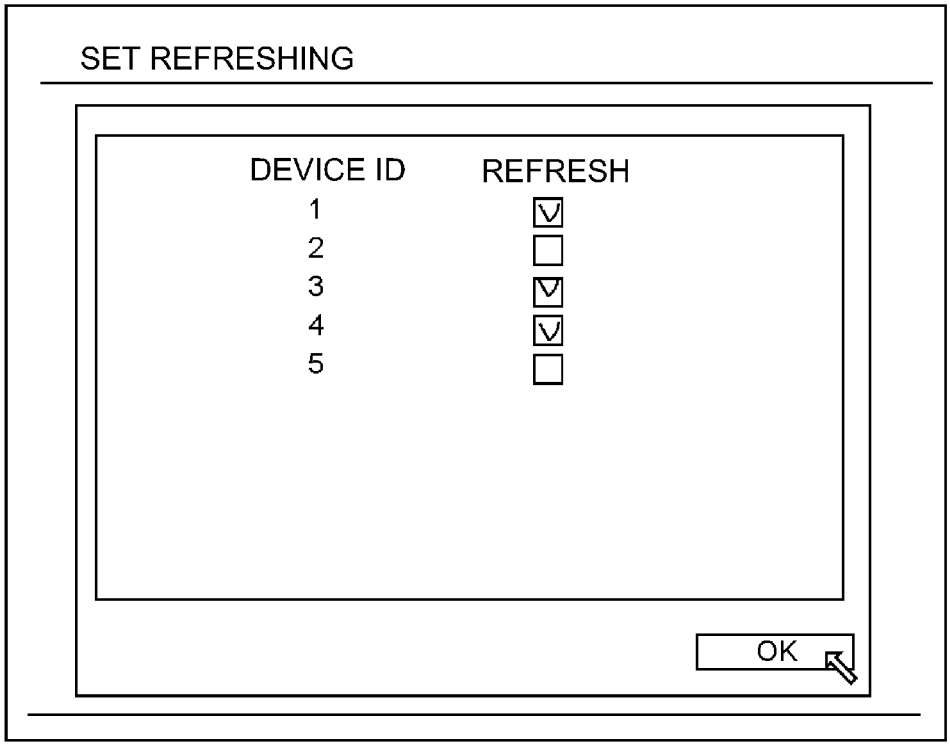
FIG. 25 shows an example of a display screen for setting the fixing element refreshing operation in the server side.

In this embodiment, the fixing element refreshing operation setting by the operator is carried out through the operating portion 180 of the image forming apparatus 100, but it can be carried out through the operating portion 805 of the server 400. For example, the CPU801 displays a screen as shown in FIG. 25 on the operating portion 805, through which the permission or non-permission of the fixing element refreshing operation is set for each of the IDs of the fixing devices. FIG. 25 shows an example of a display screen for setting the fixing element refreshing operation in the server side.

In this embodiment, the memory 154 functions as the discrimination portion, but the discrimination portion may have another structure. For example, similarly to Embodiment 2, a resistor and/or DIP switch is usable.

[Embodiment 4]

In Embodiment 1, the information (set information) corresponding to the setting of whether to permit the execution of the fixing element refreshing operation is stored in the memory 154 of the first fixing device 150. The CPU301 controls whether to permit the execution of the fixing element refreshing operation on the basis of the information.

In Embodiment 2, the set information is stored in the main assembly memory 312 in correlation with the ID of the first fixing device 150 The CPU301 controls whether to permit the execution of the fixing element refreshing operation on the basis of the information.

In Embodiment 3, the set information is stored in the server 400 in correlation with the ID of the first fixing device 150. The CPU301 controls whether to permit the execution of the fixing element refreshing operation on the basis of the information.

In this embodiment, the set information is stored in both of the memory 154 of the first fixing device 150 and the main assembly memory 312. In the following, the description will be made mainly on the difference from the Embodiment 1.

The memory 154 of the first fixing device 150 as the fixing storing portion stores the set information and the information of the date and time information (simply time information hereinafter) at which the set information is stored in the memory 154. The time information is acquired from the output of the clock 313 at the instant of the recording of the set information in the memory 154 by the CPU301, and the time information is recorded in the memory 154 by the CPU301. In addition, in the memory 154, the ID of the fixing device is stored as the identifying information for discriminating the fixing device from others, and therefore, the memory 154 also functions as the discrimination portion.

On the other hand, as another storing portion, the main assembly memory 312 of the image forming apparatus 100 works. The main assembly memory 312 stores the set information having the same content as the information recorded in the memory 154, the time information add which the information is recorded in the memory 154, the fixing device ID of first fixing device 150 in correlation with each other.

Part (a) of FIG. 26 shows an example of the information stored in the memory of the fixing device, and (b) shows an example of the information stored in the main assembly memory.

The time information is stored for the discrimination whether the set information stored in the memory 154 or the set information stored in the main assembly memory 312 is to be relied on. The CPU301 controls the execution of the fixing element refreshing operation on the basis of the later one of the information stored in the main assembly memory 312 and the information stored in the memory 154. If the times of them are the same, either of the information may be used.

The structure of this embodiment is particularly effective when the set information for the first fixing device 150 set by the image forming apparatus 100 is changed by another image forming apparatus 200 having the same structures as the image forming apparatus 100. That is, with the structure of this embodiment, the set information set by the other image forming apparatus 200 can be succeed by the image forming apparatus 100.

The same applies to the second fixing device 170. In the second fixing device 170, the memory 174 functions as the fixing device storing portion. In the following, the description will be made taking the first fixing device 150 as an example, but the same applies to the second fixing device 170.

(17. Control Flow 4)

Referring to flow charts of FIGS. 27-29 and FIG. 12 of Embodiment 1, the description will be made particularly on the difference from Embodiment 1. The operations of the flow charts are carried out by the CPU301 functioning as the executing portion (recording portion) controlling the related mechanisms of the image forming apparatus 100 in accordance with the control program stored in the ROM 303. The description will be made as to the first fixing device 150, but the same applies to the second fixing device 170.

(17. 1. Setting Sequence)

FIG. 27 is a flow chart of a setting sequence. In this embodiment, the default setting indicative of the mission of the fixing element refreshing operation is pre-stored in the memory 154. The operator can change the setting using the setting sequence of FIG. 9 depending on usage or the preference of the operator. The default setting may be non-execution of the fixing element refreshing operation. However, the default setting is preferably the permission of the fixing element refreshing operation, because it is supposed that one fixing device is used for a plurality of width sizes of the recording materials 102, unless the user wants to use different fixing devices for different width sizes.

The steps S1301 and S1302 are the same as the S101 and S102, respectively of FIG. 9, and therefore, the description thereof is omitted.

When the permission of the fixing element refreshing operation is set by the operator (S1303, Yes), the CPU301 proceeds to step S1304 to write "execution" of the fixing roller refreshing operation in the memory 154 (S1304). That is, the CPU301 records the information indicative of permission of the fixing element refreshing operation as the set information. In addition, the CPU301 writes the "execution" in the main assembly memory 312 as the fixing element refreshing operation setting (S1305). In S1305, the CPU301 records it in correlation with the ID of the first fixing device 150 mounted in the image forming apparatus 100. That is, the CPU301 records in the main assembly memory 312 the information indicative of the permission of the fixing element refreshing operation in correlation with the ID of the first fixing device 150, as the set information.

When the prohibition of the fixing element refreshing operation is set by the operator, the CPU301 proceeds to step S105 (S103, No) to write "non-execution" of the fixing roller refreshing operation in the memory 154 (S1306). That is, the CPU301 records the information indicative of prohibition of the fixing element refreshing operation as the set information. In addition, the CPU301 writes the "execution" in the main assembly memory 312 as the fixing element refreshing operation setting (S1307). In S1307, the CPU301 records it in interrelation with the ID (identifying information) of the first fixing device 150 mounted in the image forming apparatus 100. That is, the CPU301 records in the main assembly memory 312 the information indicative of the prohibition of the fixing element refreshing operation in correlation with the ID of the first fixing device 150.

In S1305 and S1307, the ID of the first fixing device 150 is already acquired in the sequence (FIGS. 28, 29) upon the actuation of the main switch 101 and then the closure of the front door 140. When the ID of the first fixing device 150 is stored in the main assembly memory 312, the information of the fixing element refreshing operation setting is recorded in correlation therewith. If the ID of the first fixing device 150 is not recorded in the main assembly memory 312, the CPU301 records the ID of the first fixing device 150 and the information of the fixing element refreshing operation setting in correlation with each other.

In S1308, the CPU301 records, in the memory 154 and the main assembly memory 312, the time information (date and time information) at which the set information is recorded in the memory 154. That is, the CPU301 stores the information indicative of the time at which the process of the step S1304 or S1306 is completed, in the memory 154 and in the main assembly memory 312. At this time, the CPU301 records the time information in correlation with the set information recorded in the step S1304 or S1306, in the memory 154. Also, in main assembly memory 312, the time information is recorded in correlation with the set information and the identifying information recorded in the step S1305 or S1307.

The time recorded in the step S1308 may be other than the time at which the process of the S1304 or S1306 is completed. For example, it may be the time at which the fixing element refreshing operation setting is carried out in the operating portion 180, or may be the time at which the process of the S1305 or S1307 is completed.

(17. 3. Sequence Upon Actuation of the Main Switch and Upon Closing the Front Door)

FIG. 28 is a flow chart showing the operations from the actuation of a main switch to a stand-by mode.

A step S1401 is the same as the step S201 of FIG. 10, and therefore, the description thereof is omitted.

In S1402, the CPU301 reads the data out of the memory 154 of the first fixing device 150 mounted in the image forming apparatus 100.

In S1403, the CPU301 reads the data out of the main assembly memory 312.

In S1404, the CPU301 discriminates whether or not the main assembly memory 312 stores the set information corresponding to the ID of a first fixing device 150 acquired the in the step S1402. More particularly, the CPU301 searches the data for the ID of the first fixing device 150 read out in the step S1402 in the main assembly memory 312.

If any data for the ID of the first fixing device 150 read out in the step S1402 is stored in the main assembly memory 312 (S1404, Yes), the CPU301 proceeds to step S1405. On the other hand, if the main assembly memory 312 does not store the data of the ID of the first fixing device 150 read the output in the step S1402 (S1404, No), the CPU301 proceeds to a step S1406.

When the main assembly memory 312 stores the data of the ID of the first fixing device 150, the CPU301 discriminates which of the set information of the memory 154 and the set information of the main assembly memory 312 is to be used (S1405). More particularly, the CPU301 checks which one of the recorded time of the information stored in the memory 154 and the time of the information stored in the main assembly memory 312 is later.

If the time of the information stored in the memory 154 is later than that of the main assembly memory 312 (S1405, Yes), the CPU301 proceeds to the step S1406.

In S1406, the CPU301 records the set information corresponding to the ID of the first fixing device 150 stored in the memory 154 and the time information, in the main assembly memory 312 in correlation with the ID of the first fixing device 150. By doing so, the set information in the main assembly memory 312 and the set information in the memory 154 can be renewed.

If the information regarding time of the memory 154 is later than that stored in the main assembly memory 312 corresponding to the ID of the first fixing device 150 (S1405, No), the CPU301 proceeds to the step S1407. When they are the same (S1405, No), the CPU301 proceeds to the steps S1407.

In S1407, the CPU301 stores the set information corresponding to the ID of the first fixing device 150 stored in the main assembly memory 312 and the time information, in the memory 154. More particularly, the CPU301 copies the set information corresponding to the ID of the first fixing device 150 stored in the main assembly memory 312 and the time information into the memory 154. By doing so, the set information in the main assembly memory 312 and the set information in the memory 154 can be renewed.

In S1408, if the set information for the ID of the first fixing device 150 stored in the main assembly memory 312 or the memory 154 indicates "execution" (S1408, Yes), the CPU301 proceeds to S1409. In the step S1409, the CPU301 renders ON the flag of the fixing element refreshing operation and sets it on the RAM 302.

On the other hand, in S1408, if the set information for the ID of the first fixing device 150 stored in the main assembly memory 312 or the memory 154 indicates "non-execution" (S1408, No), the CPU301 proceeds to S1410. In the step S1410, the CPU301 renders ON the flag of the fixing element refreshing operation and sets it on the RAM 302.

The set information for the first fixing device 150 starting the main assembly memory 312 and that stored in the memory 154 are the same because of the operation in S1406 or S1407, and therefore, in the S1408, either of the information in the main assembly memory 312 and the information in the memory 154 is usable. If the main assembly memory 312 stores the set information corresponding to the ID of the first fixing device 150, the set information in the main assembly memory 312 and the set information in the memory 154 are renewed on the basis of the discrimination in the step S1405. Therefore, the setting of the flag is possible on the basis of the later one of the set information for the first fixing device 150 in the main assembly memory 312 and that in the memory 154.

Then, the CPU301 proceeds to the stand-by mode.

The reading of the memory 154 in the step S1402 and the reading of the main assembly memory 312 in the step S1403 may be carried out in a plurality of steps. For example, the CPU301 may fetch the necessary information from the memory 154 and/or main assembly memory 312 for each process of the S1404 and S14056.

FIG. 29 is a flow chart showing the operations from the state in which a front door is open to the stand-by mode.

A step S1501 is the same as the step S301 of FIG. 11, and therefore, the description thereof is omitted.

The steps S1502-S1511 are the same as the steps S1401-S1410, respectively of FIG. 28, and therefore, the description thereof is omitted. Thereafter, the apparatus is shifted into the stand-by mode.

(17. 4. Sequence as to Whether to Execute Fixing Element Refreshing Operation)

The description will be made utilizing FIG. 12.

The flag on the RAM 302 discriminated in the step S405 of FIG. 12 is set on the basis of the new set information by the CPU301 upon the actuation of the main switch 101 or the closure of the front door 140 (FIGS. 28, 29). That is, the CPU301 as the controller controls whether to permit the fixing element refreshing operation on the basis of the later one of the set information stored in the main assembly memory 312, the set information stored in the memory 154, for the ID of the first fixing device 150.

This embodiment is the same as Embodiment 1 on the other respects, and the description is omitted.

In this embodiment, the flag for the fixing element refreshing operation is actuated on the RAM 302 in accordance with the set information stored in the main assembly memory 312 in correlation with the ID of the first fixing device 150. However, the set information per se of the main assembly memory 312 may correspond to the ON•OFF of the flag.

In the foregoing embodiments, the time information is stored in the memory 154 and the main assembly memory 312 as in the information for discriminating as to which of the set information stored in the memory 154 and the set information stored in the main assembly memory 312 is to be based. However, the information for selecting the information from the memory 154 or the main assembly memory 312 is not limited to the time information. For example, in place of the time information, information (number of information) of a cumulated number of recordings of the information in the memory 154 may be stored in the memory 154 and the main assembly memory 312. In such a case, the CPU301 renews the number of information stored in the memory 154 for each time of the recording of the set information in the memory 154. The CPU301 compares the number information stored in the memory 154 of the first fixing device 150 mounted in the image forming apparatus 400 and the number information stored in the main assembly memory 312, and discriminates which is larger.

As described hereinbefore, the exchange of the first fixing device 150 by the operator necessitates the opening and closing of the front door 140 of the image forming apparatus 100. When the front door 140 of the image forming apparatus 100 is opened by the operator, the first fixing device 150 may be exchanged. In addition, when the main switch 101 is off, the first fixing device 150 may have been exchanged. Therefore, upon the actuation of the main switch 101 of the image forming apparatus 100 and/or the closure of the front door 140, the CPU reads the information out of the memory 154 of the first fixing device 150 to acquire the later one of the set information of the main assembly memory 312 and the set information of the memory 154.

By this, the CPU301 can control whether to permit the fixing element refreshing operation for the first fixing device 150 in accordance with the fixing element refreshing operation setting set for each fixing device. Therefore, it is unnecessary for the operator to set the information as to whether to permit the fixing element refreshing operation each time of the replacement of the first fixing device 150, and therefore, the usability is improved.

In this example, the set information for each fixing device is stored in the memory 154 and in the main assembly memory 312, but it may be stored in the memory 154 and in the server 400.

In the description of the foregoing embodiment, the description has been made with respect to the first fixing device 150, but the same applies to the second fixing device 170.

MODIFIED EXAMPLE 1

In the foregoing, the permission or non-permission of the execution of the fixing element refreshing operation is set in the fixing element refreshing operation setting, but the structure may be such that the frequency (refresh level) of the execution of the fixing element refreshing operation can be set.

This will be described in conjunction with Embodiment 1 as an example.

In S101, S102 (FIG. 9), when the permission of the execution of the fixing element refreshing operation is selected by the operator, the CPU301 permits the operator to set the frequency of the execution of the fixing element refreshing operation. The CPU301 displays the screen shown in FIG. 30, for example, in the operating portion 180, on which the operator is capable of setting the frequency of the fixing element refreshing operation. FIG. 30 shows an example of a display screen for refresh level setting.

When, for example, the operator selects "low" as to the refresh level, the CPU301 executes the fixing element refreshing operation for each event of exceeding 500 recording materials fed to the first fixing device 150. When, for example, the operator selects "high" as to the refresh level, the CPU301 executes the fixing element refreshing operation for each event of exceeding 250 recording materials fed to the first fixing device 150.

The information indicating that the correspondence between the choice of the refresh level and the specific frequency of the execution of the fixing element refreshing operation is pre-stored in the ROM 303.

By the selection of the high frequency of the fixing element refreshing operation, the influence to the glossiness unevenness can be reduced. However, the high frequency of the fixing element refreshing operation results in the high frequency of the down times in the printing job execution (30 sec, for example), thus decreasing the operating rate of the image forming apparatus 100. For this reason, the default setting of the refresh level is preferably "low".

The information (frequency information) indicating the refresh level said by the operator is recorded in the memory 154 together with the set information by the CPU301.

In this example, when the operator selects the permission of the execution of the fixing element refreshing operation, the frequency of the execution of the fixing element refreshing operation is set by the operator, but this is not restrictive to the present invention. As an alternative structure, the choice of the refresh level may include the non-execution of the fixing element refreshing operation. In S101, S102 (FIG. 9), the CPU301 displays one screen, not in two stages including the screens shown in FIG. 7 and FIG. 30, on the operating portion 180. Also in this case, the operating portion 180 functions as the setting portion for setting whether to execute the fixing element refreshing operation.

The same applies to the second fixing device 170.

The modified example 1 has been described in conjunction with Embodiment 1, but it may be used with any one of Embodiments 2-4. The foregoing description applies to the case that it is used with Embodiments 1-4.

MODIFIED EXAMPLE 2

In modified example 1, the frequency of the execution of the fixing element refreshing operation can be selected as the setting of the refresh level, but the setting of the refresh level may be the rubbing treatment duration of the single fixing element refreshing operation may be made selectable.

This will be described in conjunction with Embodiment 1 as an example.

When the permission of the execution of the fixing element refreshing operation is selected by the operator in S101, S102 (FIG. 9), the CPU301 permits the operator to select the time duration (rubbing time) of the rubbing treatment in the fixing element refreshing operation.

For example, "long" or "short" is selectable on the refresh level selection screen. When the "long" of the refresh level is selected by the operator, the CPU301 executes the fixing element refreshing operation for 40 sec for each exceeding the predetermined value with respect to the number of the recording material fed to the first fixing device 150. When the "short" of the refresh level is selected by the operator, the CPU301 executes the fixing element refreshing operation for 20 sec for each exceeding the predetermined value with respect to the number of the recording material fed to the first fixing device 150.

The information indicating that the correspondence between the choice of the refresh level and the specific durations of the execution of the fixing element refreshing operation is pre-stored in the ROM 303.

By the long time duration of the execution of the fixing element refreshing operation, the influence to the glossiness unevenness can be reduced. On the other hand, the fixing element refreshing operation (30 sec, for example) before the shifting to the stand-by mode after the finishing of the printing job or upon the actuation of the main switch, and therefore, the down time increases with the result of relatively lower operating rate image forming apparatus 100.

For this reason, the default setting of the refresh level is preferably "short".

The information (time information) indicative of the refresh level selected by the operator is recorded in the memory 154 by the CPU301.

The control flow is the same as that of Embodiment 1, and therefore, the description is omitted. In this example, in the fixing element refreshing operation of S406 (FIG. 12), the CPU301 executes the rubbing treatment for the time duration corresponding to the refresh level stored in the memory 154.

The information (time information) indicative of the refresh level selected by the operator is stored in the memory 154 together with the set information by the CPU301.

In this embodiment, when the permission of the execution of the fixing element refreshing operation is selected by the operator, the execution time duration of the rubbing treatment in the fixing element refreshing operation it is selected by the operator. As an alternative structure, the choice of the refresh level may include the non-execution of the fixing element refreshing operation. In S101, S102 (FIG. 9), the CPU301 displays one screen, not in two stages including the screens, on the operating portion 180. Also in this case, the operating portion 180 functions as the setting portion for setting whether to execute the fixing element refreshing operation.

Additionally, in the setting screen for the refresh level, both of the frequency of the execution of the fixing element refreshing operation (modified example 1) and the time duration of the rubbing treatment per unit fixing element refreshing operation may be made selectable.

The same applies to the second fixing device 170.

The modified example 1 has been described in conjunction with Embodiment 1, but it may be used with any one of Embodiments 2-4. The foregoing description applies to the case that it is used with Embodiments 1-4.

MODIFIED EXAMPLE 3

In the foregoing, the contact of the end portions of the recording materials 102 with the fixing roller 151 has been taken as the cause of the difference in glossiness on the fixed image, but the causes are not limited to that. For example, a separation claw contacting the fixing roller 151 may be provided to prevent the recording material 102 from wrapping around the fixing roller 151.

In such a case, with the accumulation of the fixing process, there is a likelihood that the contact damage may occur by the contact of the separation claw to the surface of the fixing roller 151. In the case that a plurality of separation claws are provided at intervals in the longitudinal direction (axial direction) of the fixing roller 151, the surface of the fixing roller 151 is roughened adjacent to the contact position with separation claw, with the result of unevenness of the surface state over the length of the fixing roller 151. As a result, the glossiness difference may arise on the fixed image. Even in such a case, the influence on the image quality by the contact damage can be reduced by providing the refreshing roller 156 and executing the fixing element refreshing operation.

In such a case, the setting as to whether to permit the execution of the fixing element refreshing operation may be effected for each of the fixing devices as described in the foregoing with Embodiments 1-4.

MODIFIED EXAMPLE 4

In the foregoing, the refreshing roller 156 is provided for the fixing roller 151, and the surface of the fixing member is rubbed, but a rubbing rotatable member may be provided for a surface of a pressing belt 152 and/or a pressing roller 172 to rub the surface of the pressing member.

MODIFIED EXAMPLE 5

In the foregoing, the image forming apparatus 100 comprises both of the first fixing device 150 and the second fixing device 170 (tandem fixing). However, the present invention is applicable to an image forming apparatus 100 comprising only one fixing device 150.

MODIFIED EXAMPLE 6

In the foregoing, the image forming apparatus 100 comprises the image forming stations (120-123) for forming yellow, magenta, cyan and black toner images (color image forming apparatus), but the present invention is applicable to a monochromatic image forming apparatus. For example, there is a monochromatic for forming the toner images in black only.

MODIFIED EXAMPLE 7

In the foregoing, the image forming apparatus 100 comprises an intermediary transfer belt 115 as an intermediary transfer member (intermediary transfer type), but the present invention is applicable to a direct transfer type apparatus as follows.

In such a case, the image forming station 309 includes the image forming stations (120-123) and a transfer feeding belt functioning as a transfer portion. The image forming stations (120-123) can be contacted by the transfer feeding belt. The image forming apparatus 100 feeds the recording material 102 from a recording material accommodating portion 103 to the transfer feeding belt. The transfer feeding belt electrostatically attracts the recording material 102 and carries it to a position where the recording material 102 is faced to the image forming station, and a transfer roller is provided in the inside of the belt. The transfer roller transfers the toner image formed on the image bearing member onto the recording material 102 carried on the transfer feeding belt. By this, the toner image (unfixed) is formed on the recording material 102.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-154350 filed on Aug. 4, 2015, which is hereby incorporated by reference herein in its entirety.

What is claimed is:

1. An image forming apparatus comprising:

an image forming portion configured to form an image on a recording material;

a mounting portion configured to selectively mount one of detachably mountable fixing portions;

a fixing portion mounted in said mounting portion, said fixing portion including a first rotatable member and a second rotatable member which cooperate with each other to form a nip for fixing the toner image formed on the recording material by said image forming portion and a storing portion configured to store information;

a rubbing rotatable member capable of executing a rubbing treatment of rubbing a surface of said first rotatable member;

a counter configured to count a number corresponding to a number of the recording materials on which the toner images are formed;

an obtaining portion configured to obtain information which corresponds to an instruction of an operator and which corresponds to whether to permit the execution of the rubbing treatment which is based on the number counted by said counter;

a writing portion configured to write the information obtained by said obtaining portion in said storing portion of said fixing portion mounted in said mounting portion; and a controller configured to control whether to execute the rubbing treatment which is based on the number counted by said counter, in accordance with the information stored in said storing portion of said fixing portion mounted in said mounting portion.

2. An apparatus according to claim 1, further comprising a second obtaining portion configured to obtain time information which corresponds to the instruction of an operator and which corresponds to a rubbing time in the rubbing treatment which is based on the number counted by said counter, wherein said writing portion writes the time information obtained by said second obtaining portion in said storing portion of said fixing portion mounted in said mounting portion, and wherein, when the information which is stored in said storing portion of said fixing portion mounted in said mounting portion and which corresponds to whether to permit the execution of the rubbing treatment which is based on the number counted by said counter is indicative of permission of the execution of the rubbing treatment, said controller controls the rubbing time of the execution of the rubbing treatment which is based on the number counted by said counter, in accordance with the time information stored in said storing portion of said fixing portion mounted in said mounting portion.

3. An apparatus according to claim 1, further comprising:

a display portion; and a display controller configured to display, on said display portion, an input screen for inputting the information which corresponds to whether to permit the rubbing treatment which is based on the number counted by said counter.

4. An apparatus according to claim 1, wherein, a case that (1) said obtaining portion obtains the information which corresponds to whether to permit the rubbing treatment which is based on the number counted by said counter, and said writing portion writes the information obtained by said obtaining portion in said storing portion of said fixing portion mounted in said mounting portion, (2) said fixing portion mounted in said mounting portion is replaced with another fixing portion, and (3) said fixing portion replaced with said other fixing portion is remounted in said mounting portion, and wherein said controller controls whether to execute the rubbing treatment which is based on the number counted by said counter, in accordance with the information, corresponding to whether to permit the rubbing treatment which is based on the number counted by said counter, stored in said storing portion of said remounted fixing portion.

5. An apparatus according to claim 1, wherein said fixing portion includes said rubbing rotatable member.

6. An image forming apparatus comprising:

a main assembly portion including an image forming portion configured to form an unfixed toner image on a recording material, a mounting portion configured to selectively mount one of detachably mountable fixing portions, and a storing portion configured to store information;

a fixing portion mounted in said mounting portion, said fixing portion including a first rotatable member and a second rotatable member which cooperate with each other to form a nip for fixing the unfixed toner image formed on the recording material by said image forming portion, and including a discrimination portion indicative of identifying information for discriminating from another fixing portion mountable in said mounting portion;

a rubbing rotatable member capable of executing a rubbing treatment of rubbing a surface of said first rotatable member;

a counter configured to count a number corresponding to a number of the recording materials on which the images are formed;

an obtaining portion configured to obtain information which corresponds to an instruction of an operator and which corresponds to whether to permit the execution of the rubbing treatment which is based on the number counted by said counter;

a writing portion configured to write the information obtained by said obtaining portion, in said storing portion in correlation with the identifying information of said discrimination portion of said fixing portion mounted in said mounting portion; and a controller configured to control whether to execute the rubbing treatment which is based on the number counted by said counter, in accordance with the information stored in said storing portion in correlation with the identifying information of said discrimination portion of said fixing portion mounted in said mounting portion.

7. An apparatus according to claim 6, further comprising a second obtaining portion configured to obtain time information which corresponds to the instruction of an operator and which corresponds to a rubbing time in the rubbing treatment which is based on the number of counted by said counter, wherein said writing portion writes the time information obtained by said second obtaining portion in said storing portion in correlation with the identifying information of the discrimination portion of said fixing portion mounted in said mounting portion, and wherein, when the information which is stored in said storing portion in correlation with the identifying information of the discrimination portion of said fixing portion mounted in said mounting portion and which corresponds to whether to permit the execution of the rubbing treatment which is based on the number counted by said counter is indicative of permission of the execution of the rubbing treatment, said controller controls the rubbing time of the execution of the rubbing treatment which is based on the number counted by said counter, in accordance with the time information stored in said storing portion in correlation with the identifying information.

8. An apparatus according to claim 6, further comprising:

a display portion; and a display controller configured to display, on said display portion, an input screen for inputting the information which corresponds to whether to permit the rubbing treatment which is based on the number counted by said counter.

9. An apparatus according to claim 6, wherein, in a case that (1) said obtaining portion obtains the information which corresponds to whether to permit the rubbing treatment which is based on the number counted by said counter, and said writing portion writes the information obtained by said obtaining portion in said storing portion in correlation with the identifying information of said fixing portion mounted in said mounting portion, (2) said fixing portion mounted in said mounting portion is replaced with another fixing portion, and (3) said fixing portion replaced with said other fixing portion is remounted in said mounting portion, and wherein said controller controls whether to execute the rubbing treatment which is based on the number counted by said counter, in accordance with the information, corresponding to whether to permit the rubbing treatment which is based on the number counted by said counter, stored in said storing portion in correlation with the identifying information of said remounted fixing portion.

10. An apparatus according to claim 6, wherein said fixing portion includes said rubbing rotatable member.

11. An apparatus according to claim 6, wherein said discrimination portion includes a storing portion configured to store the identifying information.

12. An image forming apparatus capable of communicating with a storing device storing information, said apparatus comprising:

an image forming portion configured to form a toner image on a recording material:

a mounting portion configured to selectively mount one of detachably mountable fixing portions;

a fixing portion mounted in said mounting portion, said fixing portion including a first rotatable member and a second rotatable member which cooperate with each other to form a nip for fixing the toner image formed on the recording material by said image forming portion, and including a discrimination portion indicative of identifying information for discriminating from another fixing portion mountable in said mounting portion;

a rubbing rotatable member capable of executing a rubbing treatment of rubbing a surface of said first rotatable member;

a count configured to count a number corresponding to a number of the recording materials on which the toner images are formed;

a first obtaining portion configured to obtain information which corresponds to an instruction of an operator and which corresponds to whether to permit the execution of the rubbing treatment which is based on the number counted by said counter;

a sending portion configured to send, to the storing device, the information, corresponding to whether to permit the rubbing treatment which is based on the number counted by said counted obtained by said first obtaining portion;

a second obtaining portion configured to obtain, from the storing device, the information which is stored in the storing device in correlation with the identifying information of said discrimination portion of said fixing portion mounted in said mounting portion and which corresponds to whether to permit the rubbing treatment which is based on the number counted by said counter; and a controller configured to control whether to execute the rubbing treatment which is based on the count value of said counter, in accordance with the information obtained by said second obtaining portion.

13. An apparatus according to claim 12, further comprising a third obtaining portion configured to obtain time information which corresponds to the instruction of an operator and which corresponds to a rubbing time in the rubbing treatment which is based on the number counted by said counter, wherein said sending portion sends, to the storing device, the time information obtained by said third obtaining portion in correlation with the identifying information of said discrimination portion of said fixing portion mounted in said mounting portion, wherein said second obtaining portion obtains, from the storing device, the time information stored in the storing device in correlation with the identifying information of said discrimination portion of said fixing portion mounted in said mounting portion, and wherein, when the information obtained by said second obtaining portion is indicative of permission of the execution of the rubbing treatment which is based on the number counted by said counter, said controller controls the rubbing time of the execution of the rubbing treatment which is based on the number counted by said counter, in accordance with the time information obtained by said second obtaining portion.

14. An apparatus according to claim 12, further comprising: a display portion; and a display controller configured to display, on said display portion, an input screen for inputting the information which corresponds to whether to permit the rubbing treatment which is based on the number counted by said counter.

15. An apparatus according to claim 12, wherein said fixing portion includes said rubbing rotatable member.

16. An apparatus according to claim 12, wherein said discrimination portion includes a storing portion configured to store the identifying information.

17. An image forming system comprising:

(A) an image forming apparatus including:

(a) an image forming portion configured to form a toner image on a recording material;

(b) a mounting portion configured to selectively mount one of detachably mountable fixing portions;

(c) a fixing portion mounted in said mounting portion, said fixing portion including a first rotatable member and a second rotatable member which cooperate with each other to form a nip for fixing the toner image formed on the recording material by said image forming portion, and including a discrimination portion indicative of identifying information for discriminating from another fixing portion mountable in said mounting portion;

(d) a rubbing rotatable member capable of executing a rubbing treatment of rubbing a surface of said first rotatable member; and (e) a counter configured to count a number corresponding to a number of the recording materials on which the toner images are formed;

(B) a storing portion configured to store information, (C) an obtaining portion configured to obtain information which corresponds to an instruction of an operator and which corresponds to whether to permit the execution of the rubbing treatment which is based on the number counted by said counter; and (D) a writing portion configured to write the information obtained by said obtaining portion in said storing portion in correlation with the identifying information of said discrimination portion of said fixing portion mounted in said mounting portion, wherein said image forming apparatus further includes (f) a controller configured to control whether to execute the rubbing treatment which is based on the number counted by said counter, in accordance with the information stored in said storing portion in correlation with the identifying information of said discrimination portion of said fixing portion mounted in said mounting portion.

18. An image forming apparatus comprising:

an image forming portion configured to form a toner image on a recording material;

a mounting portion configured to selectively mount one of detachably mountable fixing portions;

a fixing portion mounted in said mounting portion, said fixing portion including a first rotatable member and a second rotatable member which cooperate with each other to form a nip for fixing the toner image formed on the recording material by said image forming portion, a discrimination portion indicative of identifying information for discriminating from another fixing portion mountable in said mounting portion, and a fixing device storing portion configured to store information;

a rubbing rotatable member capable of executing a rubbing treatment of rubbing a surface of said first rotatable member;

a counter configured to count a number corresponding to a number of the recording materials on which the toner images are formed;

a main assembly storing portion configured to store information;

an obtaining portion configured to obtain information which corresponds to an instruction of an operator and which corresponds to whether to permit the execution of the rubbing treatment which is based on the number counted by said counter;

a writing portion configured to write the information obtained by said obtaining portion in said fixing device storing portion of said fixing portion mounted in said mounting portion, and to write the information obtained by said obtaining portion in said main assembly storing portion in correlation with the identifying information of said discrimination portion of said fixing portion mounted in said mounting portion; and a controller configured to control whether to execute the rubbing treatment which is based on the number counted by said counter, on the basis of the information stored in said main assembly storing portion in correlation with the identifying information of said discrimination portion of said fixing portion mounted in said mounting portion and the information stored in said fixing device storing portion of said fixing portion mounted in said mounting portion.

19. An image forming apparatus comprising:

an image forming portion configured to form a toner image on a recording material;

a mounting portion configured to selectively mount one of detachably mountable fixing portions;

a fixing portion mounted in said mounting portion, said fixing portion including a first rotatable member and a second rotatable member which cooperate with each other to form a nip for fixing the toner image formed on the recording material by said image forming portion, a discrimination portion indicative of identifying information for discriminating from another fixing portion mountable in said mounting portion, and a fixing device storing portion configured to store information;

a rubbing rotatable member capable of executing a rubbing treatment of rubbing a surface of said first rotatable member;

a counter configured to count a number corresponding to a number of the recording materials on which the toner images are formed;

a main assembly storing portion configured to store information;

an obtaining portion configured to obtain information which corresponds to an instruction of an operator and which corresponds to whether to permit the execution of the rubbing treatment which is based on the number counted by said counter;

a writing portion configured to write the information obtained by said obtaining portion in said fixing device storing portion of said fixing portion mounted in said mounting portion, and to write the information obtained by said obtaining portion in said main assembly storing portion in correlation with the identifying information of said discrimination portion of said fixing portion mounted in said mounting portion; and a controller configured to discriminate which of the information stored in said main assembly storing portion in correlation with the identifying information of said discrimination portion of said fixing portion mounted in said mounting portion and the information stored in said fixing device storing portion of said fixing portion mounted in said mounting portion is later, said controller determines whether to execute the rubbing treatment which is based on the number counted by said counter, on the basis of the later information.

20. An apparatus according to claim 19, further comprising a second obtaining portion for obtaining time information corresponding to time, after said first obtaining portion obtains the information, wherein said writing portion writes the information obtained by said obtaining portion in said main assembly storing portion in correlation with the identifying information of said fixing portion and the time information obtained by said second obtaining portion, and writes the information obtained by said obtaining portion in said fixing device storing portion in correlation with the time information obtained by said second obtaining portion, and wherein said controller determines, as the later information, the information of the information stored in said main assembly storing portion in correlation with the identifying information of said discrimination portion of said fixing portion mounted in said mounting portion or the information stored in said fixing device storing portion of said fixing portion mounted in said mounting portion that is correlated with later time information.

21. An apparatus according to claim 20, further comprising an operating portion configured to permit an operator to input the information which corresponds to an instruction of an operator and which corresponds to whether to permit the execution of the rubbing treatment which is based on the number counted by said counter, wherein said obtaining portion obtains the information through the operating portion.

22. An apparatus according to claim 20, further comprising an output portion configured to output the time information.

23. An apparatus according to claim 19, wherein said fixing device storing portion stores number information corresponding to an accumulated number of writings of the information into said fixing device storing portion, wherein said writing portion writes the information obtained by said obtaining portion in said fixing device storing portion and rewrites the number information stored in said fixing device storing portion, after said obtaining portion obtains the information, and said writing portion writes the rewritten number information of the accumulated number, in said main assembly storing portion, in correlation with the information obtained by said obtaining portion and the identifying information of said fixing portion, and wherein said controller determines, as the later information, the information stored in said main assembly storing portion in correlation with the identifying information of said discrimination portion of said fixing portion mounted in said mounting portion or the information stored in said fixing device storing portion of said fixing portion mounted in said mounting portion that is correlated with a larger accumulated number.

24. An apparatus according to claim 23, further comprising an operating portion configured to permit an operator to input the information which corresponds to an instruction of an operator and which corresponds to whether to permit the execution of the rubbing treatment which is based on the number counted by said counter, wherein said to obtaining portion obtains the information through the operating portion.

25. An apparatus according to claim 19, wherein said fixing portion includes said rubbing rotatable member.

26. An apparatus according to claim 19, wherein said discrimination portion is integral with said fixing portion storing portion, and said fixing portion storing portion stores the identifying information.

* * * * *